US008995874B2

(12) United States Patent
Akutsu et al.

(10) Patent No.: US 8,995,874 B2
(45) Date of Patent: Mar. 31, 2015

(54) IMAGE FORMING APPARATUS

(75) Inventors: Takashi Akutsu, Odawara (JP); Ken Kikuchi, Mishima (JP); Tsutomu Nishiuwatoko, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 484 days.

(21) Appl. No.: 13/312,216

(22) Filed: Dec. 6, 2011

(65) Prior Publication Data

US 2012/0148293 A1 Jun. 14, 2012

(30) Foreign Application Priority Data

Dec. 8, 2010 (JP) ..... 2010-273911

(51) Int. Cl.

| | |
|---|---|
| ***G03G 15/00*** | (2006.01) |
| ***G03G 21/18*** | (2006.01) |
| ***G03G 15/32*** | (2006.01) |
| ***G03G 21/16*** | (2006.01) |
| ***G03G 15/04*** | (2006.01) |

(52) U.S. Cl.

CPC ..... *G03G 21/1821* (2013.01); *G03G 15/326* (2013.01); *G03G 21/1633* (2013.01); *G03G 15/04045* (2013.01); *G03G 2221/1651* (2013.01)

USPC ..... 399/110

(58) Field of Classification Search

CPC ..... G03G 2221/169; G03G 21/1633; G03G 2221/1654; G03G 21/1666; G03G 21/1821; G03G 15/326

USPC ..... 399/110

See application file for complete search history.

(56) References Cited

U.S. PATENT DOCUMENTS

| | | | | |
|---|---|---|---|---|
| 7,356,283 | B2 | 4/2008 | Igarashi | |
| 2009/0317128 | A1 * | 12/2009 | Jang | 399/110 |
| 2011/0142490 | A1 * | 6/2011 | Kikuchi et al. | 399/111 |

* cited by examiner

*Primary Examiner* — David Gray
*Assistant Examiner* — Andrew V Do
(74) *Attorney, Agent, or Firm* — Canon USA Inc. IP Division

(57) ABSTRACT

Provided is a configuration in which a scanner is mounted to a cartridge door via an elastic member, and the scanner is positioned relative to a frame that can be mounted to and demounted from an apparatus main body and that supports an intermediate transfer member and a photosensitive member using an urging force of the elastic member.

8 Claims, 20 Drawing Sheets

IMAGE FORMING APPARATUS

BACKGROUND OF THE INVENTION

1. Field of the Invention

The present invention relates to an electrophotographic image forming apparatus in which a cartridge is detachably mounted in an apparatus main body and which forms an image on a recording medium.

Here, the electrophotographic image forming apparatus is an apparatus that forms an image on a recording medium using an electrophotographic image forming process. Examples of the electrophotographic image forming apparatus include an electrophotographic copying machine, an electrophotographic printer (for example, a laser beam printer and an LED printer), a facsimile machine, and a word processor. The recording medium is a medium on which an image is formed by the electrophotographic image forming apparatus, examples of which include paper and an OHT (overhead transparency) sheet.

2. Description of the Related Art

A known image forming apparatus (electrophotographic image forming apparatus) using an electrophotographic image forming process in the related art employs a process cartridge system. The process cartridge system is such that a process cartridge in which a photosensitive drum (electrophotographic photosensitive drum), a developing roller that acts on the photosensitive drum, and a developing unit that accommodates toner for use in image formation are integrated to form a single unit is detachably mounted in an apparatus main body. The process cartridge system allows a user to perform maintenance of the apparatus by himself or herself without the help of a serviceman. Therefore, the process cartridge system is widely used in electrophotographic image forming apparatuses. In addition to the foregoing process cartridge system, there are various kinds of cartridge system. For example, there are a developing cartridge system in which a developing roller and toner are accommodated and a toner cartridge system in which only toner is accommodated. An optimum system is selected from them in consideration of the apparatus configuration, cost, etc.

An example of known electrophotographic image forming apparatuses has a configuration in which a scanner unit serving as an exposing unit is mounted to a covering member that opens and closes an opening for mounting and demounting a plurality of cartridges (U.S. Pat. No. 7,356,283). With this configuration, when the covering member is opened to mount or demount the cartridges, the scanner unit retracts, and thus, the ease of operation for mounting and demounting the cartridges can be improved.

U.S. Pat. No. 7,356,283 discloses an image forming apparatus capable of color image formation. In this image forming apparatus, a plurality of cartridges are disposed next to each other diagonally above and below.

SUMMARY OF THE INVENTION

The present invention is developed from the related art described above.

The present invention provides an image forming apparatus capable of high-accuracy positioning of an exposing unit relative to a photosensitive member to be exposed to light so as to form high-quality images.

Further features of the present invention will become apparent from the following description of exemplary embodiments with reference to the attached drawings.

DESCRIPTION OF THE EMBODIMENTS

Embodiments of the present invention will be described in detail hereinbelow with reference to the drawings. It is to be understood that the scope of the present invention is not limited to the sizes, materials, shapes, the relative positions, etc. of components described in the embodiments unless otherwise stated.

First Embodiment

Figure 1A:
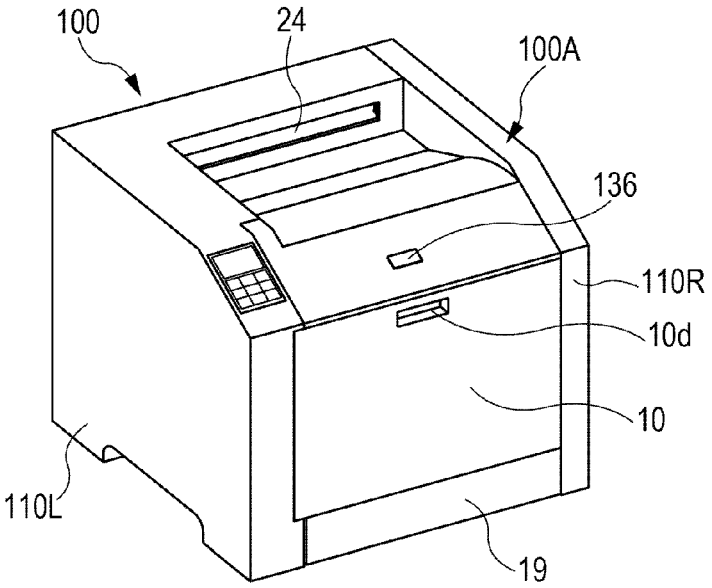
FIG. 1A is an external perspective view of an image forming apparatus of a first embodiment.
Figure 1B:
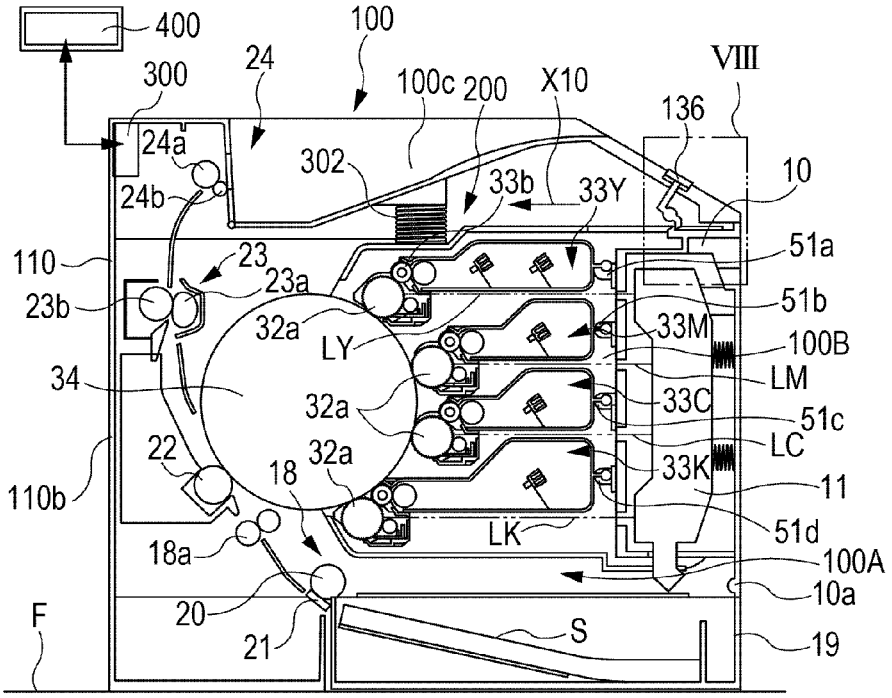
FIG. 1B is a longitudinal left side view of the image forming apparatus of the first embodiment.

Overall Schematic Configuration of Example of Electrophotographic Image Forming Apparatus FIG. 1A is an external perspective view of an electrophotographic image forming apparatus (hereinafter referred to as an image forming apparatus) 100 of this embodiment. FIG. 1B is a longitudinal left side view of the image forming apparatus 100. The image forming apparatus 100 is a four-full-color laser printer using an electrophotographic process.

Specifically, the image forming apparatus 100 forms a full color image on a recording medium (sheet) S on the basis of an electrical image signal input from an external host unit 400, such as a personal computer, an image reader, and a sending-side facsimile machine, to a control circuit unit 300.

In the description below, for the image forming apparatus 100, "front" is a direction in which a feeding cassette 19 that accommodates the stacked recording medium S is drawn outward from the interior of an apparatus main body 100A; "rear" is opposite thereto; "above" is a direction in which the recording medium S is output; "front-to-back direction" includes a direction in which the image forming apparatus 100 is viewed from the rear to the front (forward direction) and a direction opposite thereto (backward); "left and right" are the sides of the image forming apparatus 100 as viewed from the front; "lateral direction" includes a right-to-left direction (leftward) and a direction opposite thereto (rightward); and "longitudinal direction" is the axial direction of an electrophotographic photosensitive drum or a developing roller. An apparatus main body 100A is part of the image forming apparatus 100 excluding cartridges 33 (33Y, 33M, 33C, and 33K) and an image forming unit 200. The right side of the image forming apparatus 100 of this embodiment is a drive side and the left side is a non-drive side.

The image forming apparatus 100 is placed on a substantially horizontal installation surface F of a table, a desk, a floor, etc. At the center in the apparatus main body 100A is disposed the image forming unit 200.

Figure 2:
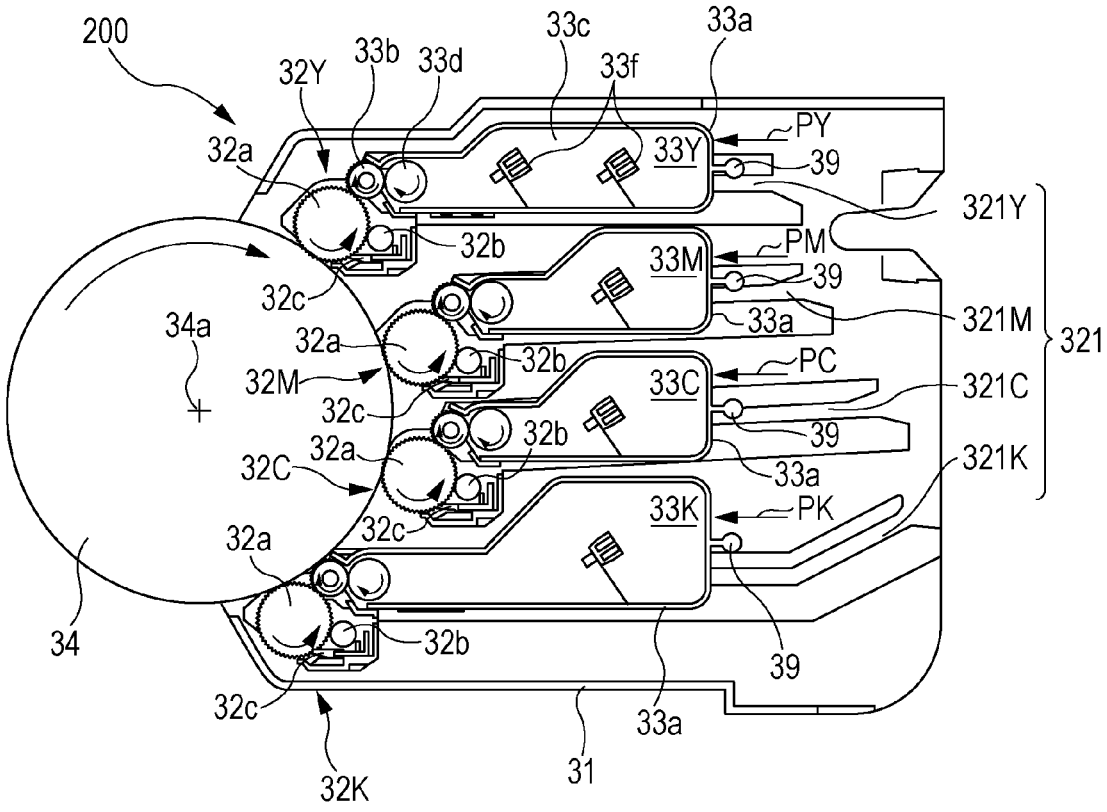
FIG. 2 is an enlarged view of an image forming unit in FIG. 1B.

FIG. 2 is an enlarged view of the image forming unit 200 in FIG. 1B. The unit 200 has a subframe (support frame) 31 that can be mounted and demounted to/from a main frame 110 of the apparatus main body 100A. The unit 200 is equipped with cartridge mount portions 321 (321Y, 321M, 321C, and 321K) in which a plurality of cartridges, that is, first to fourth four developing cartridges 33 (33Y, 33M, 33C, and 33K) in this embodiment, are detachably mounted. The unit 200 further includes a single intermediate transfer member 34 on the subframe 31. In this embodiment, electrophotographic photosensitive drums 32*a* of the individual developing cartridges 33 are mounted in the unit 200 together with charging rollers 32*b* and cleaning blades 32*c*. The charging rollers 32*b* and the cleaning blades 32*c* are processing units. The image forming apparatus 100 forms a color image on the recording medium S with the plurality of cartridges 33 that are detachably mounted in the apparatus main body 100A (unit 200). The image forming unit 200 can be mounted and demounted to/from the apparatus main body 200A, as described above. This can simplify the replacement of the intermediate transfer member 34, the photosensitive drums 32*a*, and the processing units, such as the charging rollers 32*b* and the cleaning blades 32*c*, such as when the lifetimes have expired. More detailed configuration of the unit 200 will be described later. In this embodiment, the individual developing cartridges 33 accommodate different color developers (toners), of which the developing cartridge 33K that accommodates a black developer has a developer accommodating portion 33*c* with a larger capacity than the developing cartridges 33 that accommodate the other color developers; however the present invention is not limited thereto. For example, they may have the same configuration except that the colors of developers (toners) accommodated in the individual developing cartridges 33 differ. In this embodiment, although developing cartridges are described as an example of the cartridges, the present invention is not limited thereto. For example, this embodiment may be configured such that the drums (photosensitive drums) 32*a*, the charging rollers 32*b*, and the cleaning blades 32*c* mounted in the unit 200 may be mounted in the developing cartridges 33. With such a configuration, the cartridges are not referred to as the developing cartridges but referred to as process cartridges. This is because the drums 32*a* and the processing units, such as the charging rollers 32*b*, the developing rollers 33*b*, and the cleaning blades 32*c*, are integrated into a cartridge and are detachably mounted in the apparatus main body 100A.

Photosensitive Drum

The individual photosensitive drums 32*a* are fixed to the subframe 31 of the image forming unit 200. The subframe 31 is further provided with the charging rollers 32*b* and the cleaning blades 32*c* for removing developers remaining on the surfaces of the drums 32*a*, which serve as processing units for the drums 32*a*. The drums 32*a*, the charging rollers 32*b*, and the cleaning blades 32*c* are mounted in a predetermined placement relationship.

Cartridge

As shown in FIG. 2, the cartridges 33 (33Y, 33M, 33C, and 33K) each have a developing unit. Specifically, the cartridges 33 each have a housing 33*a* and a developing roller 33*b* for supplying a developer to the drum 32*a*, in other words, for developing an electrostatic latent image formed on the drum 32*a* as a developer image. The cartridges 33 each further have a developer accommodating portion 33*c* that accommodates a developer used in developing the electrostatic latent image and a supply roller 33*d* that supplies the developer in the developer accommodating portion 33*c* to the developing roller 33*b*. The developer accommodating portion 33*c* has a conveying member 33*f* for conveying the internal developer to the supply roller 33*d*. The first cartridge 33Y accommodates a yellow (Y) developer in the developer accommodating portion 33*c* and forms a Y-color developer image on the surface of the corresponding drum 32*a*. The second cartridge 33M accommodates a magenta (M) developer in the developer accommodating portion 33*c* and forms an M-color developer image on the surface of the corresponding drum 32*a*. The third cartridge 33C accommodates a cyan (C) developer in the developer accommodating portion 33*c* and forms a C-color developer image on the surface of the corresponding drum 32*a*. The fourth cartridge 33K accommodates a black (K) developer in the developer accommodating portion 33*c* and forms a K developer image on the surface of the corresponding drum 32*a*.

Figure 3A:
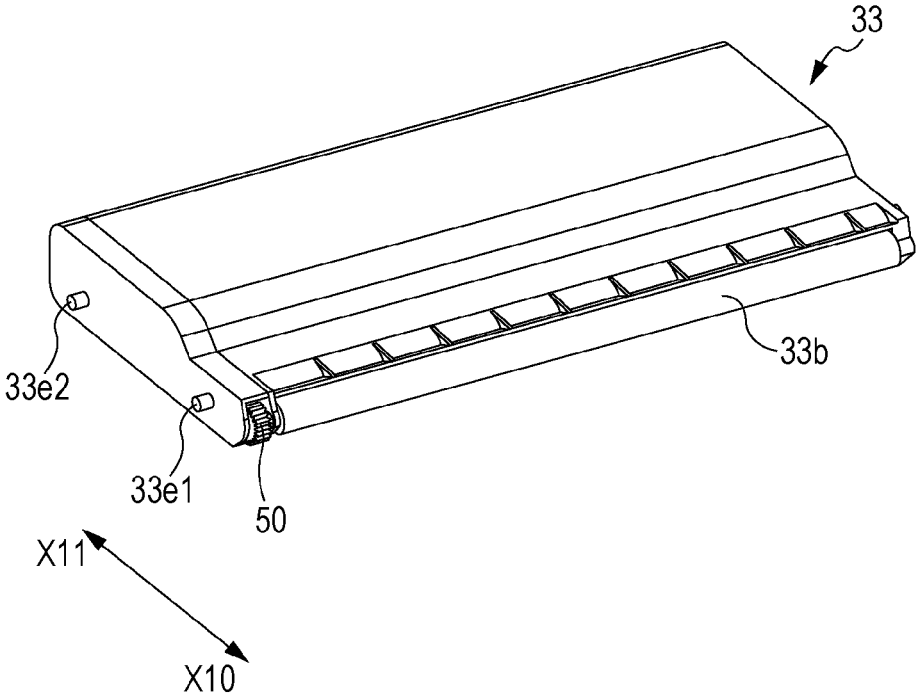
FIG. 3A is a right rear perspective view of a cartridge.
Figure 3B:
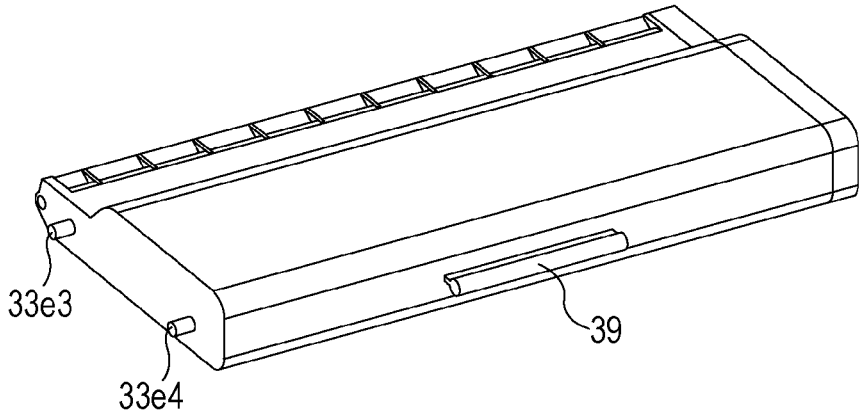
FIG. 3B is a left front perspective view of the cartridge 33Y.

FIG. 3A is a perspective view of the cartridge 33Y viewed from the right rear. FIG. 3B is a perspective view of the cartridge 33Y viewed from the left front. The cartridges 33 will be described taking the cartridge 33Y as an example. The cartridge 33Y is mounted to the mount portion 321Y of the unit 200 in the direction of an arrow X10. The cartridge 33Y is demounted from the mount portion 321Y of the unit 200 in the direction of an arrow X11 opposite to the arrow X10.

The cartridge 33Y has the developing roller 33*b* at the distal end thereof in the mounting direction. A gear 50 is provided at the right end of the developing roller 33*b*. The gear 50 receives a driving force from a drum gear 32*a*1 (FIG. 5A) to rotate the developing roller 33*b*. The gear 50 further transmits the driving force to the supply roller 33*d* and the conveying members 33*f* via a gear train (not shown).

Guided portions 33*e*1 and 33*e*2 and guided portions 33*e*3 and 33*e*4 for the cartridge 33Y to be guided to the unit 200 are provided at the right and left sides of cartridge 33Y, respectively. The guided portions 33*e*1, 33*e*2, 33*e*3, and 33*e*4 each have a cylindrical shape projecting outwards from the right and left sides of the cartridge 33Y.

A grip 39 (see FIG. 2) for gripping the cartridge 33Y is provided at the side of the cartridge 33Y opposite to the developing roller 33*b*. The user can mount and demount the cartridge 33Y to/from the unit 200 by gripping the grip 39. The other cartridges 33M, 33C, and 33K also have the grip 39 to allow the user to mount and demount them to/from the unit 200 by gripping the respective grips 39.

Figure 5A:
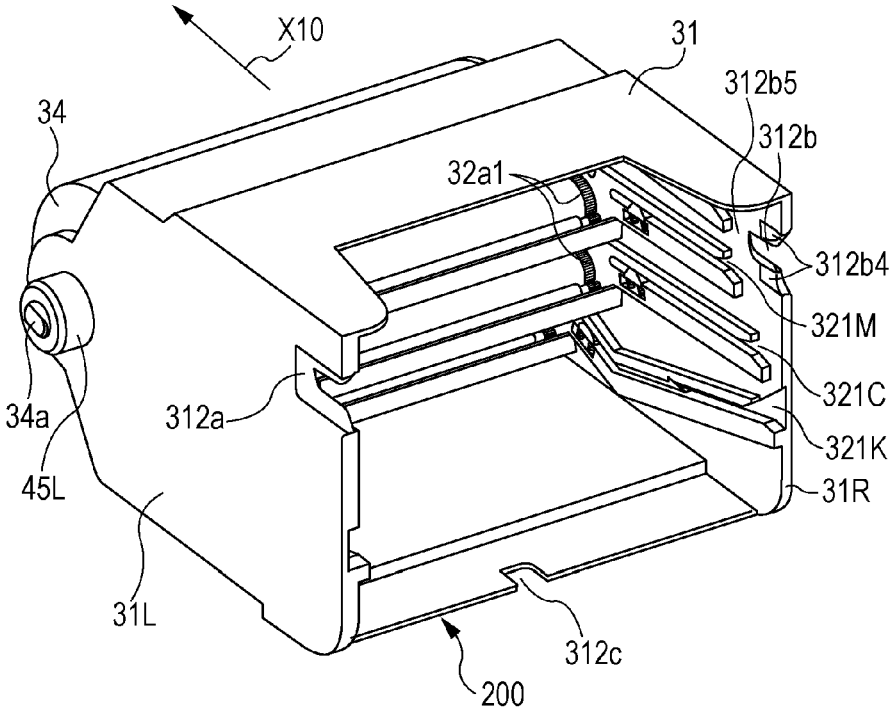
FIG. 5A is a left perspective view of the image forming unit.
Figure 5B:
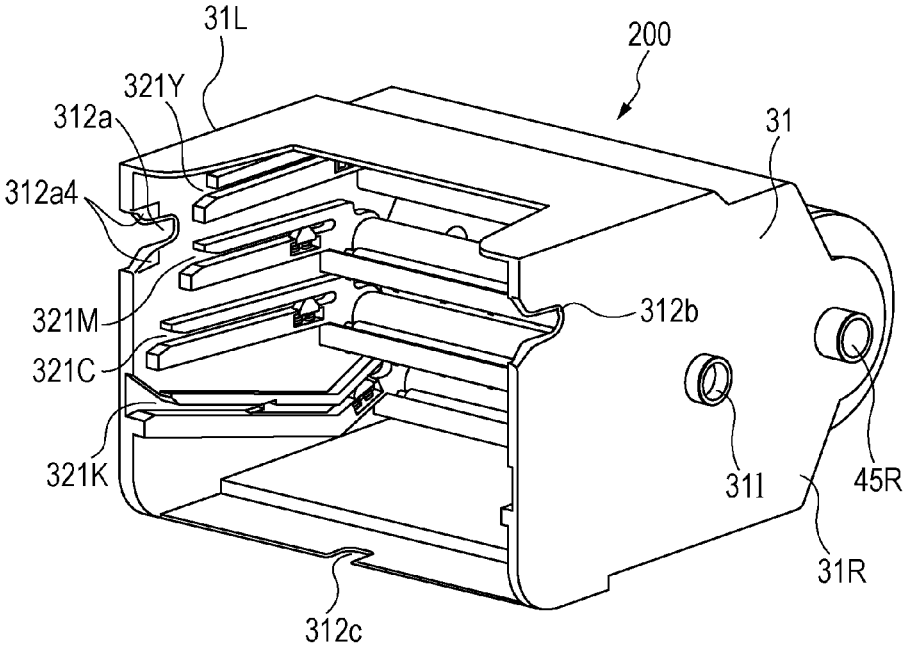
FIG. 5B is a right perspective view of the image forming unit.
Figure 5C:
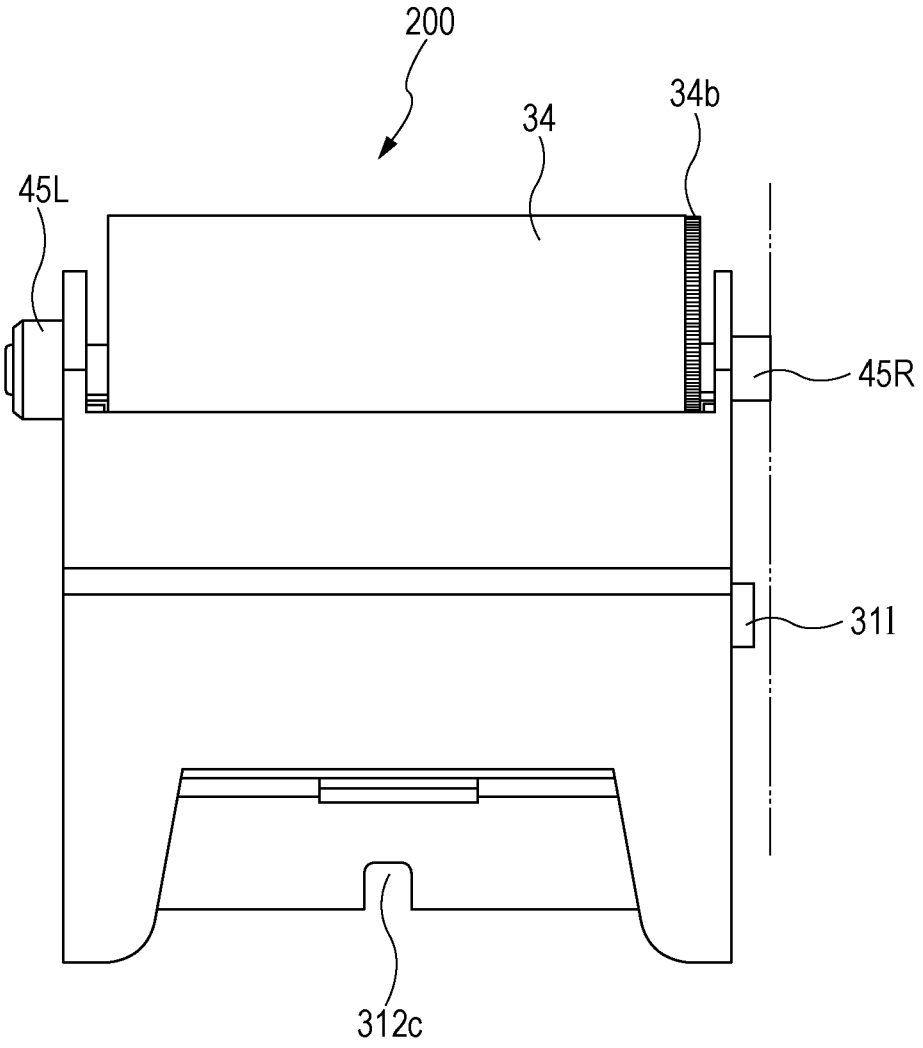
FIG. 5C is a top view of the image forming unit.

As shown in FIGS. 5A to 5*c*, in this embodiment, the intermediate transfer member 34 is a cylindrical drum whose central rotation shaft 34*a* extends in the lateral direction and which is disposed horizontally so as to be rotatable about the shaft 34*a*. The cartridges 33 are arranged next to each other from above to below in the vertical direction, in front of the intermediate transfer member 34, in a substantially horizontal orientation with respect to the installation surface F for the apparatus main body 100A. In the image forming apparatus of this embodiment, the first cartridge 33Y is in the highest row, and the second cartridge 33M is located therebelow. The third cartridge 33C is located further below. The fourth cartridge 33K is located in the lowest row. The developing rollers 33*b* of the cartridges 33 may either be in contact with the drums 32*a*, as a contact developing system, or be spaced a predetermined slight gap (a fixed distance) apart from the drums 32*a*, as a noncontact developing system.

Urging of Cartridges

Figure 4:
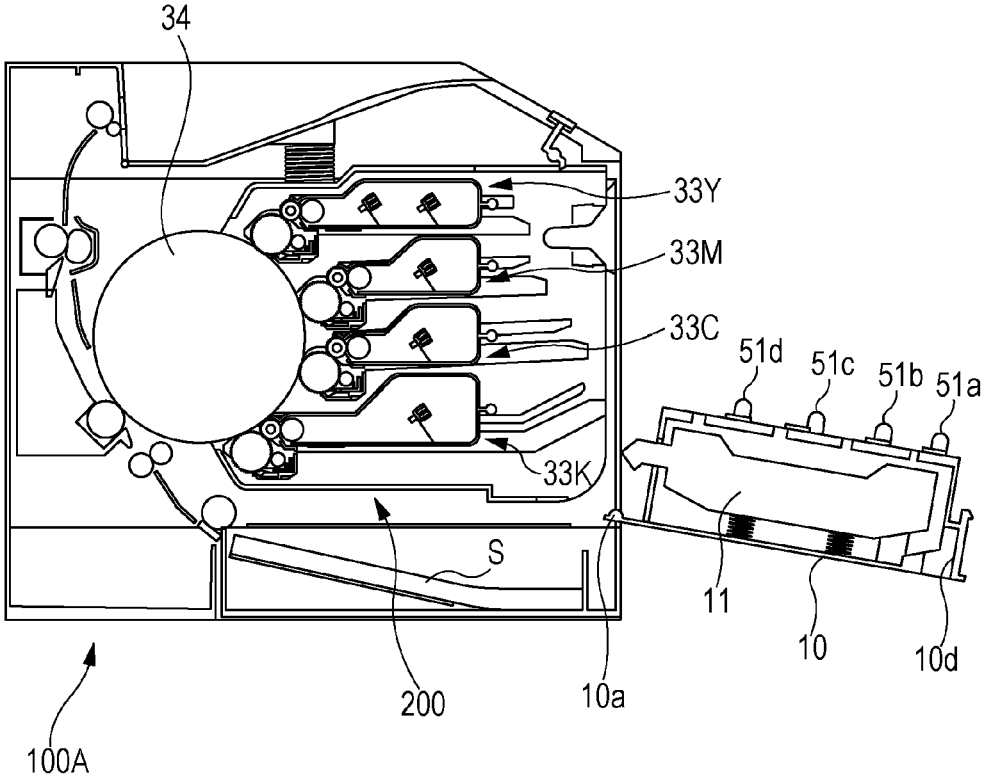
FIG. 4 is a longitudinal left side view of the image forming apparatus when a cover unit is at an opening position.

The apparatus main body 100A has cartridge urging members 51*a* to 51*d* (FIG. 4 and FIGS. 6A and 6B) that urge the individual cartridges 33 to corresponding photosensitive member units 32 (32Y, 32M, 32C, and 32K) in a state in which the unit 200 is located in an image forming position. The urging members 51*a* to 51*d* are each provided at both ends in the longitudinal direction (lateral direction) of the cartridges 33, that is, two for each of the cartridges 33. The urging members 51*a* to 51*d* are provided at the cover unit 10 and come into contact with the rear ends of the cartridges 33 in sequence in cooperation with the closing operation of the cover unit 10. When the unit 200 is in the image forming position, as shown in FIG. 1B, the cartridges 33 are urged in the directions of arrows P (PY, PM, PC, and PK) by the urging members 51*a* to 51*d*, respectively.

The developing rollers 33*b* accommodated in the cartridges 33 come into contact with the drums 32*a* with a fixed urging force by bringing control rollers (not shown) provided at both ends thereof into contact with the drums 32*a*. The urging forces of the urging members 51*a* to 51*d* suitably maintain the contact state (or the spaced-apart state) between the developing rollers 33*b* and the drums 32*a*.

Scanner Unit

As shown in FIG. 1B, a scanner unit 11 serving as an exposing unit is disposed in front (ahead) of the cartridges 33. The scanner unit 11 includes a laser diode, a polygonal mirror, an Fθ lens, and a reflecting mirror. The scanner unit 11 outputs laser light beams L (LY, LM, LC, and LK) modulated in accordance with Y-, M-, C-, K-color image information that is input to the control circuit unit 300 from the external host unit 400 to expose the drums 32*a* of the cartridges 33 of corresponding colors to the light.

The scanner unit 11 is mounted in the cover unit 10 which is a covering member for opening and closing an opening 100B for mounting and demounting the cartridges 33.

The details of the mounting and positioning of the scanner unit 11 of this embodiment will be described later.

Recording-Medium Conveying Mechanism

As shown in FIG. 1B, a feeding unit 18 is disposed below the image forming unit 200. The feeding unit 18 includes a feeding cassette 19 that accommodates the stacked recording mediums S, a feeding roller 20, and a separation pad 21. The feeding cassette 19 can be taken in and out (mounted and demounted to/from) from the front of the apparatus main body 100A (front loading). In the apparatus main body 100A, a recording-medium conveying path extending from the feeding roller 20 to the upper rear in the apparatus main body 100A is formed between the intermediate transfer member 34 and a rear frame 110*b* of the apparatus main body 100A. A registration roller pair 18*a*, a secondary transfer roller 22, a fixing unit 23, and a discharge roller pair 24 are disposed from below to above in the conveying path. The fixing unit 23 includes a fixing film unit 23*a* and a pressure roller 23*b*. The discharge roller pair 24 is composed of a discharge roller 24*a* and a discharge roller 24*b*. An output tray 100*c* that receives the recording mediums S on which images are formed is disposed on the upper surface of the apparatus main body 100A.

The cover unit 10 is an opening and closing member that can open and close the opening 100B provided at the front of the apparatus main body 100A. The cover unit 10 is fitted with the scanner unit 11. As will be described below, the opening 100B is an opening for mounting and demounting the cartridges 33 to/from the unit 200. Thus, the cartridges 33 can be mounted and demounted by bringing the cover unit 10 that holds the scanner unit 11 to an opening position.

FIG. 1B shows a state in which the image forming apparatus 100 can perform an image forming operation.

In this state, the cover unit 10 is in a closing position at which the opening 100B is closed. The unit 200 is at an image forming position in the apparatus main body 100A in which the cartridges 3 are mounted, and image formation is performed. A gear 34*b* (FIG. 5C), which is a drive input portion of the intermediate transfer member 34 of the unit 200, connects to a drive output portion (not shown) provided at the apparatus main body 100A. A power feeding system (not shown) provided at the apparatus main body 100A is conducting to electrical contacts (not shown) between the drums 32*a* and the charging rollers 32*b* and the cartridges 33. Although the driving system and the bias applying system described above are not shown for ease of explanation, they may have the same configuration as that of an ordinary image forming apparatus.

An operation for forming a full-color image will be described with reference to FIGS. 1B and 2.

The drums 32*a* are rotationally driven counterclockwise in the direction of the arrows at a predetermined speed. The charging rollers 32*b* are rotated as the drums 32*a* are rotationally driven. The intermediate transfer member 34 is also rotationally driven clockwise in the direction of the arrow (reverse direction to the rotation of the drums 32*a*) at a speed corresponding to the speed of the drums 32*a*. The developing rollers 33*b* and the supply rollers 33*d* are individually rotationally driven clockwise in the direction of the arrows at predetermined speeds. The scanner unit 11 is also driven. In synchronization with the driving, a predetermined charging bias is applied to the individual charging rollers 32*b* at a predetermined control timing.

Thus, the surfaces of the drums 32*a* are uniformly charged to a predetermined polarity and potential by the charging rollers 32*b*. The scanner unit 11 exposes the surfaces of the drums 32*a* to laser light beams L (LY, LM, LC, and LK) modulated in response to the Y-, M-, C-, and K-color image signals, respectively. Thus, electrostatic latent images corresponding to the corresponding color image signals are formed on the surfaces of the drums 32*a*. The electrostatic latent images formed on the surfaces of the drums 32*a* are developed as developer images by the developing rollers 33*b* of the corresponding cartridges 33. A predetermined developing bias is applied to the developing rollers 33*b* at a predetermined control timing.

By the foregoing electrophotographic image forming process, a Y-color developer image corresponding to the Y-color component of the full-color image is formed on the drum 32*a* that the cartridge 33Y faces. The developer image is primarily transferred onto the intermediate transfer member 34 at a primary-transfer nip portion, which is a contact portion between the drum 32*a* and the intermediate transfer member 34; an M-color developer image corresponding to the M-color component of the full-color image is formed on the drum 32*a* that the cartridge 33M faces. The developer image is superimposed, that is, primarily transferred, onto the Y-color developer image that has already been transferred onto the intermediate transfer member 34 at a primary-transfer nip portion, which is a contact portion between the drum 32*a* and the intermediate transfer member 34. A C-color developer image corresponding to the C-color component of the full-color image is formed on the drum 32*a* that the cartridge 33C faces. The developer image is superimposed, that is, primarily transferred, onto the Y-color+M-color developer image that has already been transferred onto the intermediate transfer member 34 at a primary-transfer nip portion, which is a contact portion between the drum 32*a* and the intermediate transfer member 34. A K-color developer image corresponding to the K-color component of the full-color image is formed on the drum 32*a* that the cartridge 33K faces. The developer image is superimposed, that is, primarily transferred, onto the Y-color+M-color+C-color developer image that has already been transferred onto the intermediate transfer member 34 at a primary-transfer nip portion, which is a contact portion between the drum 32*a* and the intermediate transfer member 34. In this way, an unfixed developer image in which the four full colors, Y+M+C+K, are combined, is formed on the intermediate transfer member 34.

The order of the colors of developer images transferred onto the intermediate transfer member 34 is not limited to the above. Transferred developers remaining on the surfaces of the drums 32*a* after developer images are transferred to the intermediate transfer member 34 are removed by the cleaning blades 32*c* and are pooled in individual waste-developer accommodating portions.

On the other hand, the feeding roller 20 is driven at a predetermined control timing. Thus, the sheet-like recording mediums S stacked in the feeding cassette 19 are separated and fed one by one in cooperation with the feeding roller 20 and the separation pad 21. The recording mediums S are introduced to a secondary transfer nip portion, which is a contact portion between the intermediate transfer member 34 and the secondary transfer roller 22, by the registration roller pair 18*a* at a predetermined control timing. The secondary transfer roller 22 is subjected to a secondary transfer bias with an opposite polarity to the developer charging polarity and a predetermined potential at a predetermined control timing. Thus, the four-color-superimposed developer image on the intermediate transfer member 34 is secondarily transferred onto the surface of the recording medium S in the process in which the recording medium S is conveyed through the secondary transfer nip portion. The recording medium S that has passed through the secondary transfer nip portion is separated from the surface of the intermediate transfer member 34 and is introduced to the fixing unit 23, where it is heated and pressed in a fixing nip portion. Thus, the colors of the developer images are combined and fixed to the recording medium S. The recording medium S exits from the fixing unit 23 and is ejected as a full-color-image formed medium onto the output tray 100*c* by the discharge roller pair 24. Secondary-transferred toner remaining on the surface of the intermediate transfer member 34 is removed after the recording medium S is separated from the intermediate transfer member 34. In the case of this embodiment, the remaining toner electrostatically adheres to the surfaces of the drums 32*a* at the primary-transfer nip portion between the drums 32*a* and the intermediate transfer member 34 and is removed by the cleaning blades 32*c*.

The intermediate transfer member 34 is a drum-shaped rotational body, as described above. Developer images of different colors formed on the drums 32*a* are transferred one on another onto the intermediate transfer member 34. The intermediate transfer member 34 transfers the transferred developer images together to the recording medium S. Thus, a color image is formed on the recording medium S.

In the case where a monochrome image is to be formed, a K-color developer image formed on the drum 32*a* that the cartridge 33K faces is transferred to the intermediate transfer member 34. The intermediate transfer member 34 transfers the transferred K-color developer image to the recording medium S, so that a K-color image is formed on the recording medium S.

The secondary transfer roller 22 in this embodiment can be moved by a shift mechanism (not shown) to a first position at which it is in contact with the intermediate transfer member 34 to form the secondary transfer nip portion and a second position at which it is separate from, that is, out of contact with, the intermediate transfer member 34. When the forming apparatus 100 is in an image forming operation, the secondary transfer roller 22 is moved to the first position, and not in an image forming operation, it is moved to the second position. The secondary transfer roller 22 may also be configured to be normally in contact with the intermediate transfer member 34.

Image Forming Unit

The configuration of the image forming unit 200 will be described with reference to FIGS. 5A to 5C.

FIG. 5A is a perspective view of the unit 200 as viewed from the left, FIG. 5B is a perspective view of the unit 200 as viewed from the right, and FIG. 5C is a top view thereof.

The unit 200 includes the subframe 31 that can be mounted and demounted to/from the main frame 110 of the apparatus main body 100A. The subframe 31 rotatably supports the intermediate transfer member 34 formed by coating the circumferential surface of a cylinder with an elastic member. The intermediate transfer member 34 is supported such that the left end and the right end of the central shaft (rotation center) 34*a* are rotatably supported between a left side plate 31L and a right side plate 31R of the subframe 31. The intermediate transfer member 34 has the gear 34*b*, at the right end, that transmits a driving force to the individual drums 32*a*.

The gear 34*b* transmits a driving force transmitted from the apparatus-main-body driving source (not shown) to the drum gears 32*a*1. The drums 32*a* are disposed around the intermediate transfer member 34 in a state in which they are in contact with the intermediate transfer member 34. The drums 32*a* are positioned relative to the subframe 31 with a positioning configuration (not shown) so as to be rotatable about the axes of the drums 32*a*. This allows the drums 32*a* and the intermediate transfer member 34 to be positioned relative to each other with high accuracy. The drums 32*a* are in contact with the intermediate transfer member 34 under a predetermined pressure.

A left shaft 45L and a right shaft 45R are fixed integrally with the outer surfaces of the left side plate 31L and the right side plate 31R, respectively, coaxially with the central axis 34*a* of the intermediate transfer member 34. The right side plate 31R of the subframe 31 is provided with a restricted portion 311 that restricts the inclination of the unit 200 in the apparatus main body 100A. The projection of the restricted portion 311 from the side surface of the subframe 31 is smaller than that of the right shaft 45R, as shown in FIG. 5C.

The unit 200 is located in the apparatus main body 100A by the left shaft 45L, the right shaft 45R, and the restricted portion 311, the details of which will be described later. Since the left shaft 45L, the right shaft 45R, and the inclination restricted portion 311, which are positioning portions for the intermediate transfer member 34 in the apparatus main body 100A, are provided on one subframe 31, the intermediate transfer member 34 is located in the apparatus main body 100A with high accuracy. As described above, the subframe 31 is provided with the cartridge mount portions 321 for detachably mounting the cartridges 33. The function of the mount portions 321 will be described later.

Image-Forming-Unit Mount Portion

Figure 6A:
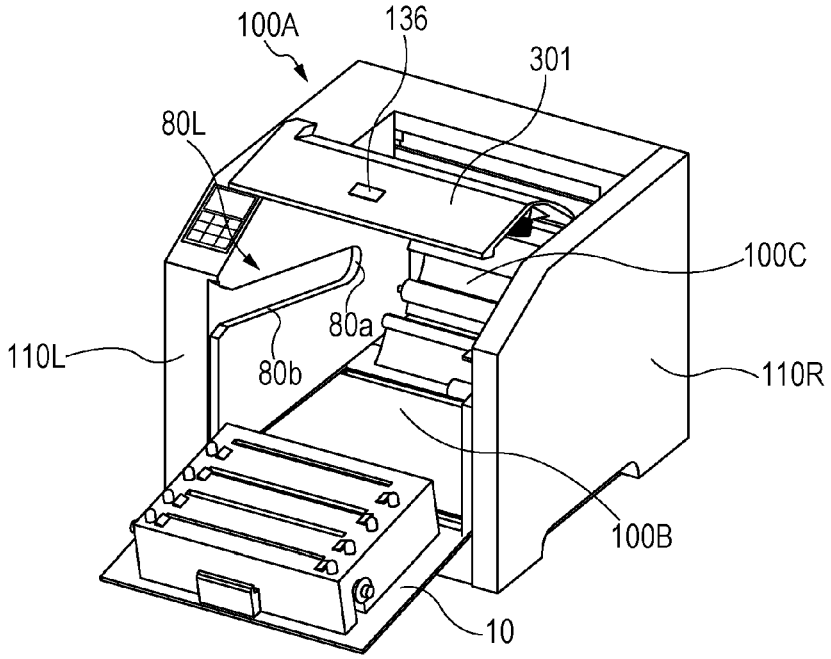
FIG. 6A is a left perspective view of an apparatus main body in a state in which a cover unit is opened.
Figure 6B:
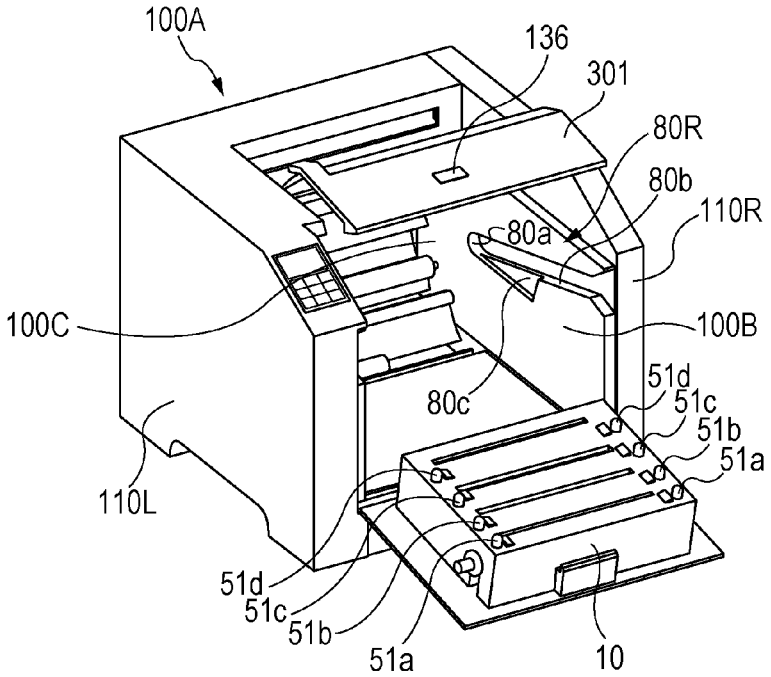
FIG. 6B is a right perspective view of the apparatus main body in a state in which the cover unit is opened.

As shown in FIGS. 6A and 6B, a left guide 80L and a right guide 80R are provided in an opposing state inside the left frame 110L and the right frame 110R of the apparatus main body 100A, respectively. The guides 80L and 80R each have a positioning portion 80*a* that rotatably supports the left shaft 45L or the right shaft 45R of the subframe 31 and a guide portion 80*b* that guides the shaft 45L or 45R to the positioning portion 80*a*. The right guide 80R has an inclination restricting portion 80*c*, inside in the longitudinal direction, that is recessed to a substantially horizontal surface, with which the inclination restricted portion 311 of the unit 200, described above, is in contact to restrict the rotation of the unit 200.

As shown in FIGS. 6A and 6B, the upper part of the apparatus main body 100A can be opened and closed as an upper cover unit 301 for the apparatus main body 100A.

Mounting of Image Forming Unit

Next, the mounting of the unit 200 into the apparatus main body 100A will be described with reference to FIGS. 7A to 7E and FIGS. 8A and 8B. FIGS. 7A to 7E are longitudinal right side view taken along the right guide 80R. FIGS. 8A and 8B are enlarged views of a two-dot chain line portion VIII in FIG. 1B.

The lower end of the cover unit 10 is rotatably connected to the apparatus main body 100A via a hinge shaft 10*a* and can be located at a closing position (FIG. 1B) at which it closes the opening 100B in the side surface of the apparatus main body 100A and an opening position (FIGS. 7A to 7E) at which it opens the opening 100B. In other words, the cover unit 10 is an opening and closing member that is supported rotatably about the hinge shaft 10*a* at the front of the apparatus main body 100A to open and close the opening 100B. The closing position of the cover unit 10 is maintained by the engagement (latch engagement) of a securing claw 136*a* provided at a maintenance button 136 disposed at the front of the apparatus main body 100A and a securing claw 10*b* provided at the cover unit 10, shown in FIGS. 8A and 8B. The securing claw 136*a* is a main-body-side securing portion, and the securing claw 10*b* is an opening-and-closing member-side securing portion. The closing of the cover unit 10 is released by pushing the button 136. Pushing the button 136 backwards against a return spring (not shown) moves the securing claw 136*a* of the button 136 backwards from the securing claw 10*b* of the cover unit 10 to release the latch engagement, as shown by the two-dot chain line. This allows the cover unit 10 to rotate about the hinge shaft 10*a* to the opening position, thereby opening the opening 100B wide. In this embodiment, the securing claw 136*a* and the securing claw 10*b* are in engagement elastically and releasably. However, this embodiment is not limited thereto. For example, a claw (securing portion) provided at one side may be elastically and releasably in engagement with a hole (securing portion) provided at the other side.

Figure 9A:
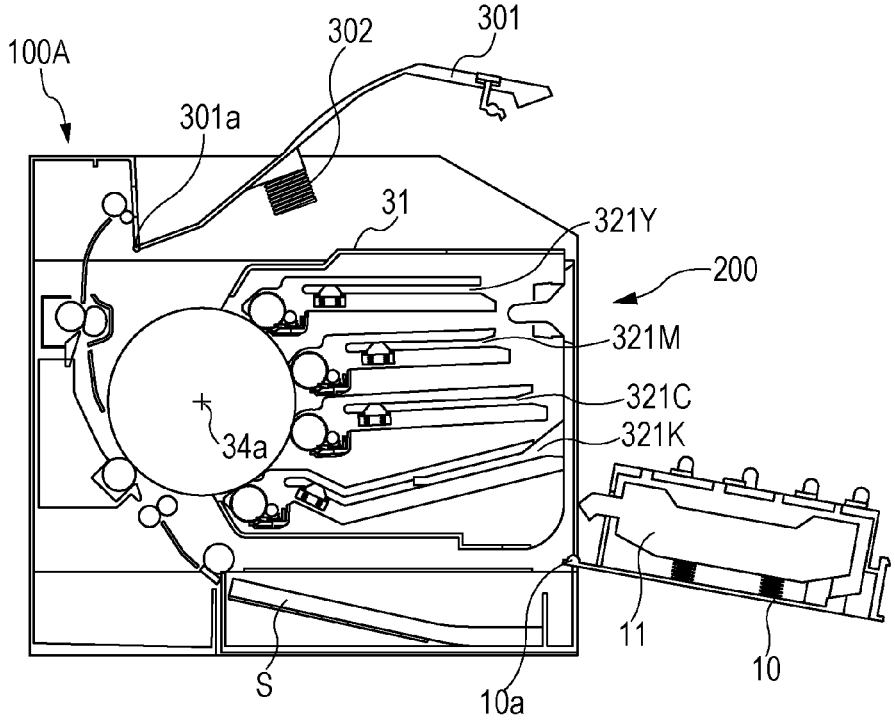
FIG. 9A is a diagram illustrating the operation of an upper cover unit.
Figure 9B:
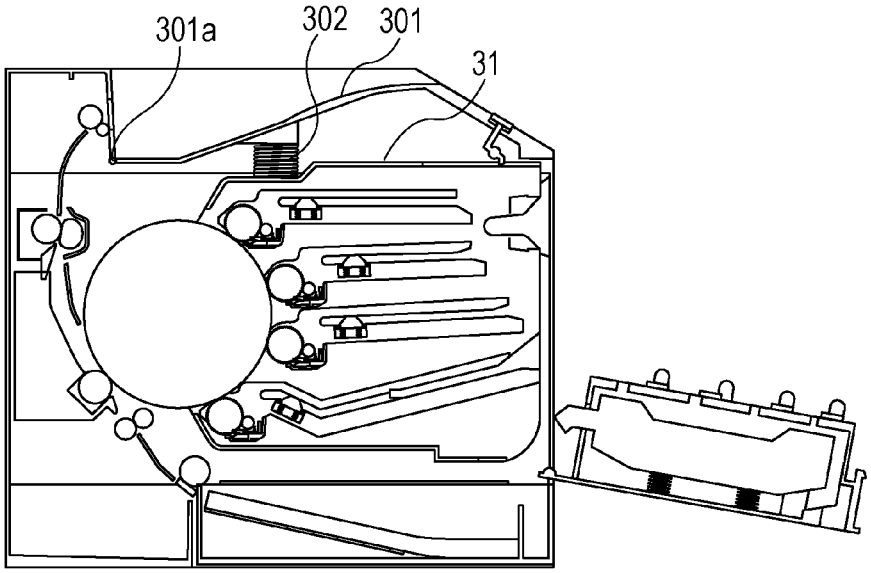
FIG. 9B is a diagram illustrating the operation of the upper cover unit.

As shown in FIGS. 9A and 9B, the upper part of the apparatus main body 100A is rotatably connected to the apparatus main body 100A, as the upper cover unit 301, via a hinge shaft 301*a*. The upper cover unit 301 can be located at a closing position (FIG. 9B) at which it closes an opening 100C in the upper surface of the apparatus main body 100A and an opening position (FIG. 9A) at which it opens the opening 100C. The closing position of the upper cover unit 301 is also maintained by an engaging mechanism (not shown) similar to that of the cover unit 10.

The mounting of the unit 200 into the apparatus main body 100A will be described.

Figure 7A:
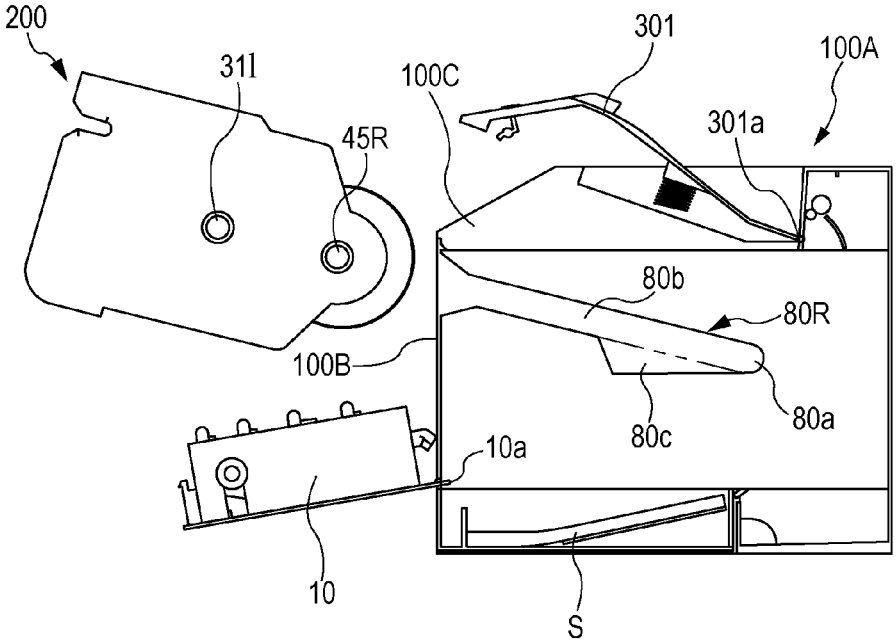
FIG. 7A is a diagram illustrating the mounting and demounting of the image forming unit.
Figure 8A:
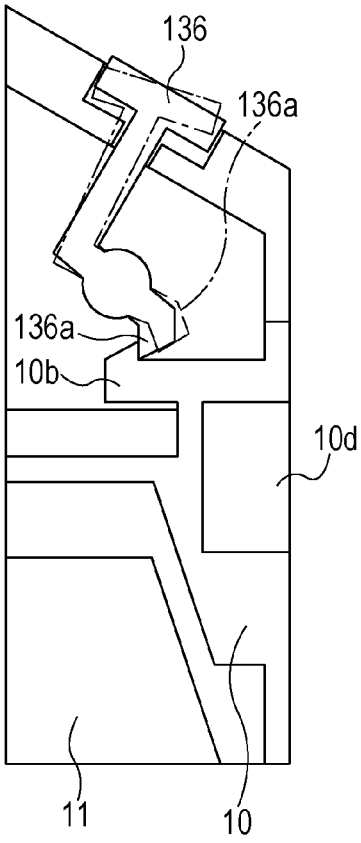
FIG. 8A is an explanatory diagram of a maintenance button.
Figure 8B:
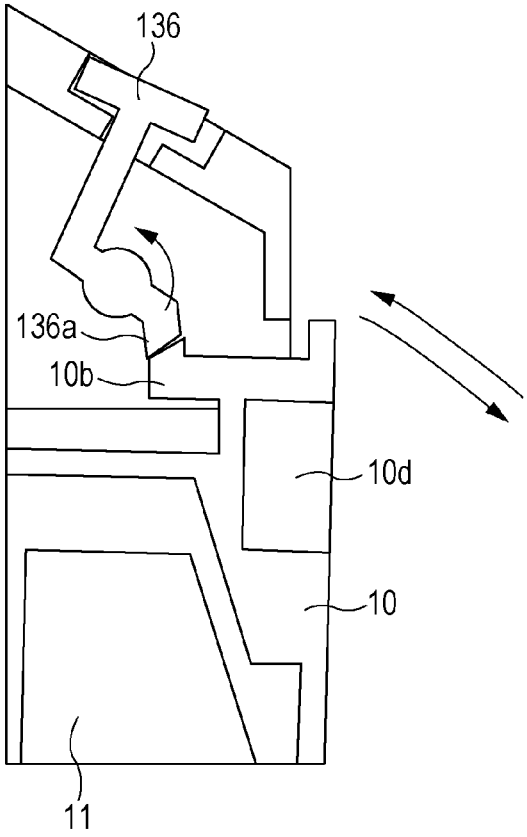
FIG. 8B is an explanatory diagram of the maintenance button

First, as shown in FIG. 7A, the upper cover unit 301 and the cover unit 10 of the apparatus main body 100A are located at opening positions.

Figure 7B:
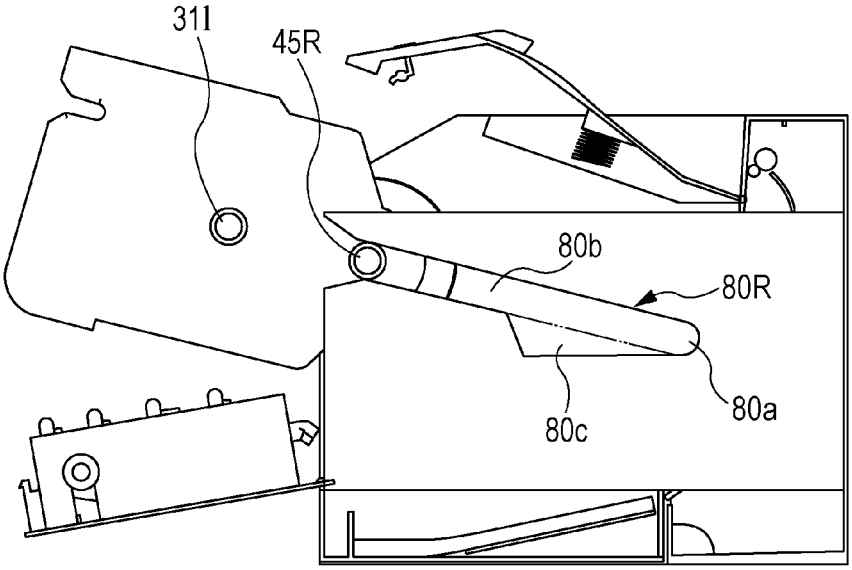
FIG. 7B is a diagram illustrating the mounting and demounting of the image forming unit.

Next, the image forming unit 200 is inserted into the apparatus main body 100A through the openings 100B and 100C. First, the left and right shafts 45L and 45R of the subframe 31 are brought into engagement with the opposing guide portions 80*b* provided at the left and right guides 80L and 80R of the apparatus main body 100A, respectively (FIG. 7B).

Figure 7C:
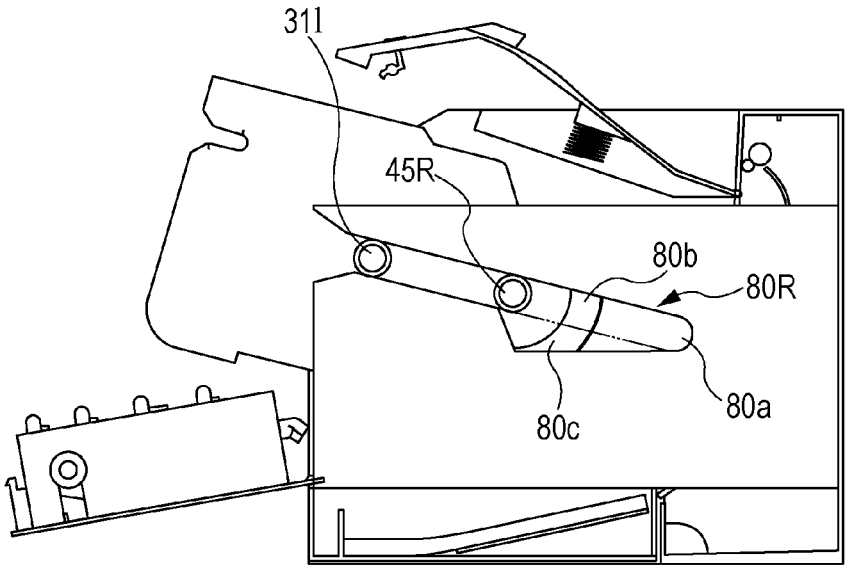
FIG. 7C is a diagram illustrating the mounting and demounting of the image forming unit.
Figure 7D:
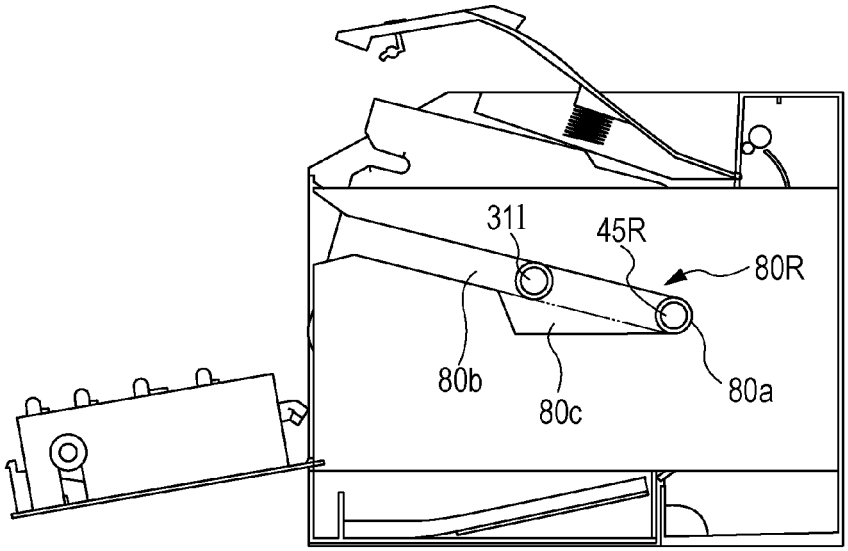
FIG. 7D is a diagram illustrating the mounting and demounting of the image forming unit.
Figure 7E:
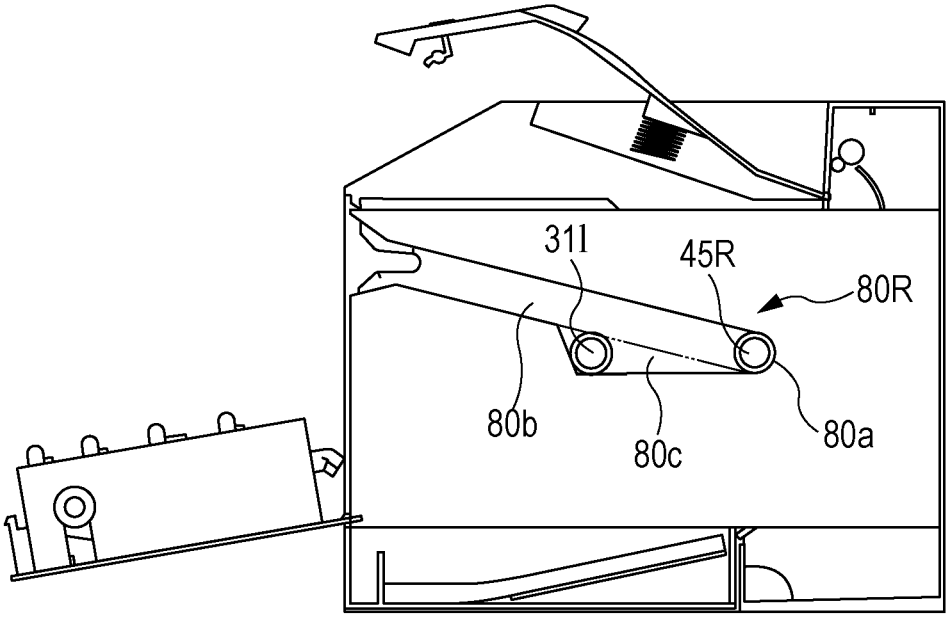
FIG. 7E is a diagram illustrating the mounting and demounting of the image forming unit.

As the mounting proceeds, the right shaft 45R reaches the rotation restricting portion 80*c* inside in the longitudinal direction (FIG. 7C). However, the right shaft 45R comes into engagement with the guide portion 80*b* outside in the longitudinal direction because of the large amount of projection from the side surface of the subframe 31, and thus, the mounting proceeds along the guide portion 80*b*. The inclination restricted portion 311 starts to come into engagement with the guide portion 80*b*. At that time, the image forming unit 200 can be mounted without interfering with the upper cover unit 301 and the cover unit 10.

As the mounting further proceeds, the left and right shafts 45L and 45R reach the positioning portions 80*a* (FIG. 7D) provided at the extensions of the guide portions 80*b*. On the other hand, the inclination restricted portion 311 comes to the rotation restricting portion 80*c* of the right guide 80R. The protrusion of the inclination restricted portion 311 from the side surface of the subframe 31 is small, and thus, it does not come into engagement with the guide portion 80*b* outside in the longitudinal direction. Therefore, the image forming unit 200 rotates to the position in FIG. 7E.

At that time, the gear 34*b* (FIG. 5C) provided at one end of the intermediate transfer member 34 is connected to a drive gear (not shown) provided in the apparatus main body 100A. Finally, the upper cover unit 301 is closed, and thus, the mounting is completed. Closing the upper cover unit 301 causes a compressing spring 302 serving as an urging member urges and presses the upper part of the subframe 31, thus allowing the image forming unit 200 to be held stably at the position in FIG. 9B.

When the unit 200 is to be removed, the procedure is opposite to the foregoing mounting procedure. Specifically, the upper cover unit 301 is moved to the opening position; the unit 200 is rotated until the inclination restricted portion 311 comes to a position at which it comes into contact with the ceiling surface of the guide portion 80*b*; and the unit 200 is extracted along the guide portion 80*b*.

After the unit 200 is mounted by the foregoing procedure, the four cartridges 33 (33Y, 33M, 33C, and 33K) are mounted to the mount portions 321 (321Y, 321M, 321C, and 321K) provided in the subframe 31.

Cover Unit

Figure 10A:
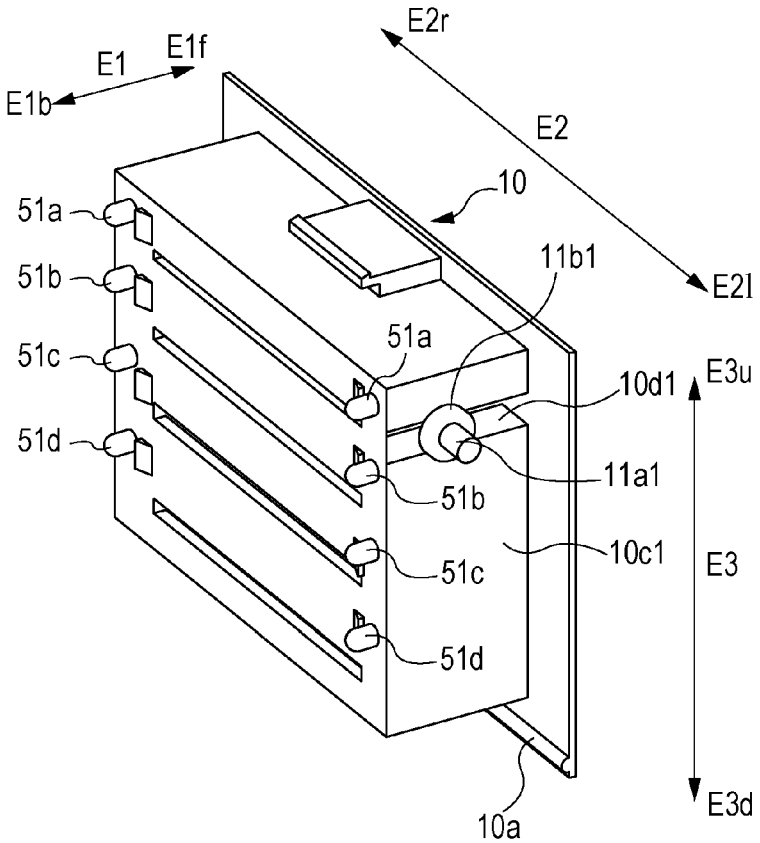
FIG. 10A is a left back perspective view of a cover unit.
Figure 10B:
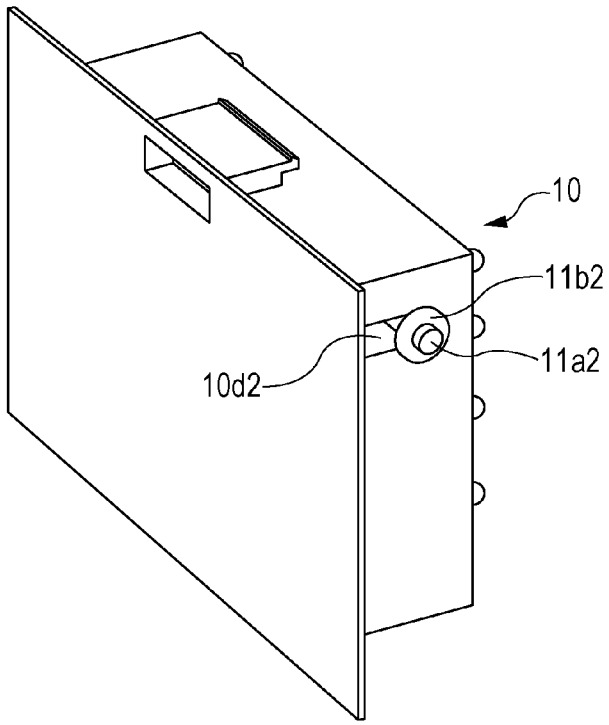
FIG. 10B is a right front perspective view of the cover unit.
Figure 11A:
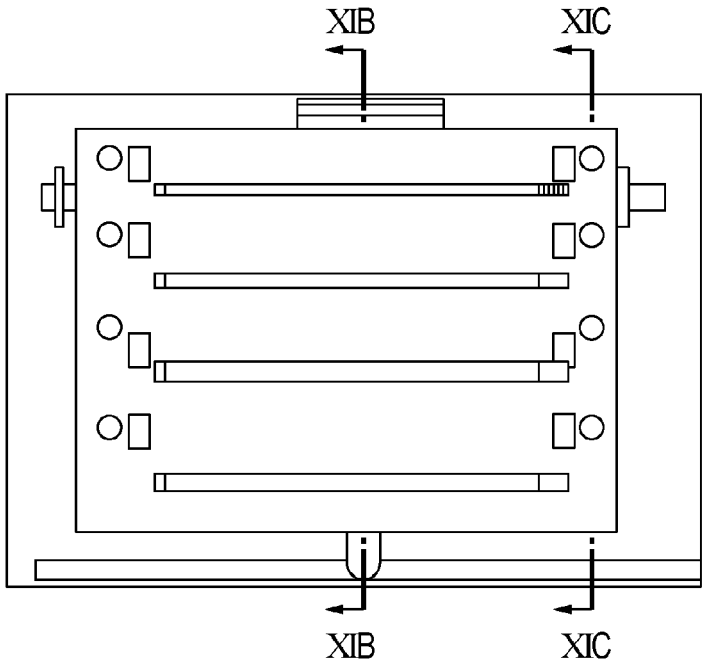
FIG. 11A is a cross-sectional view of the cover unit in the lateral direction.
Figure 11B:
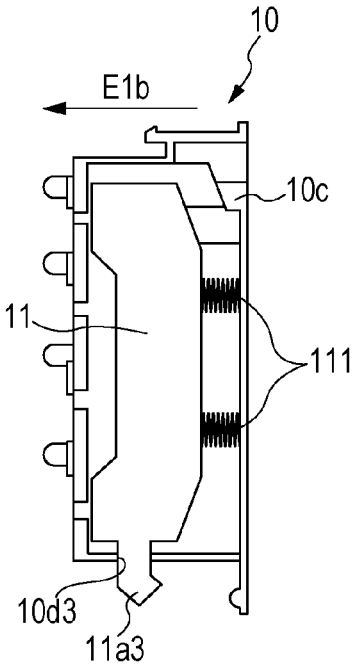
FIG. 11B is a cross-sectional view of the cover unit taken along line XIB-XIB of FIG. 11A.
Figure 11C:
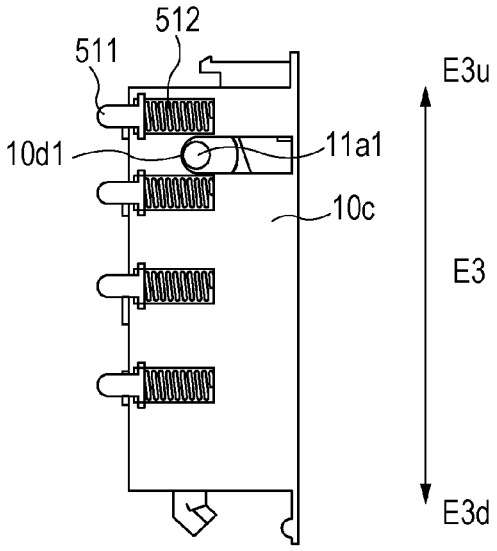
FIG. 11C is a cross-sectional view of the cover unit taken along line XIC-XIC of FIG. 11A.
Figure 12A:
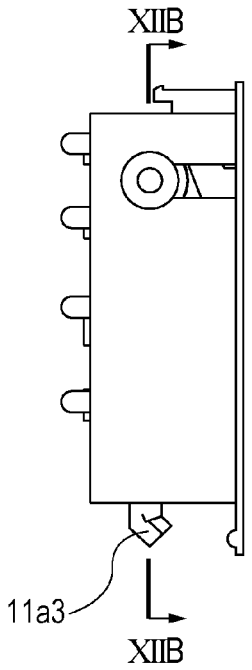
FIG. 12A is a cross-sectional view of the cover unit in the front-to-back direction.
Figure 12B:
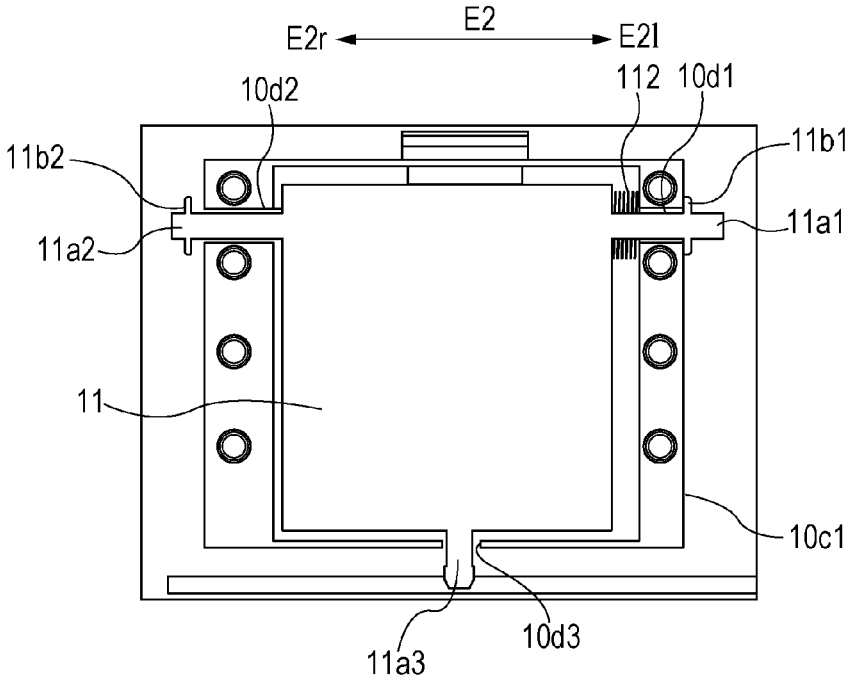
FIG. 12B is a cross-sectional view of the cover unit taken along line XIIB-XIIB of FIG. 12A.
Figure 13:
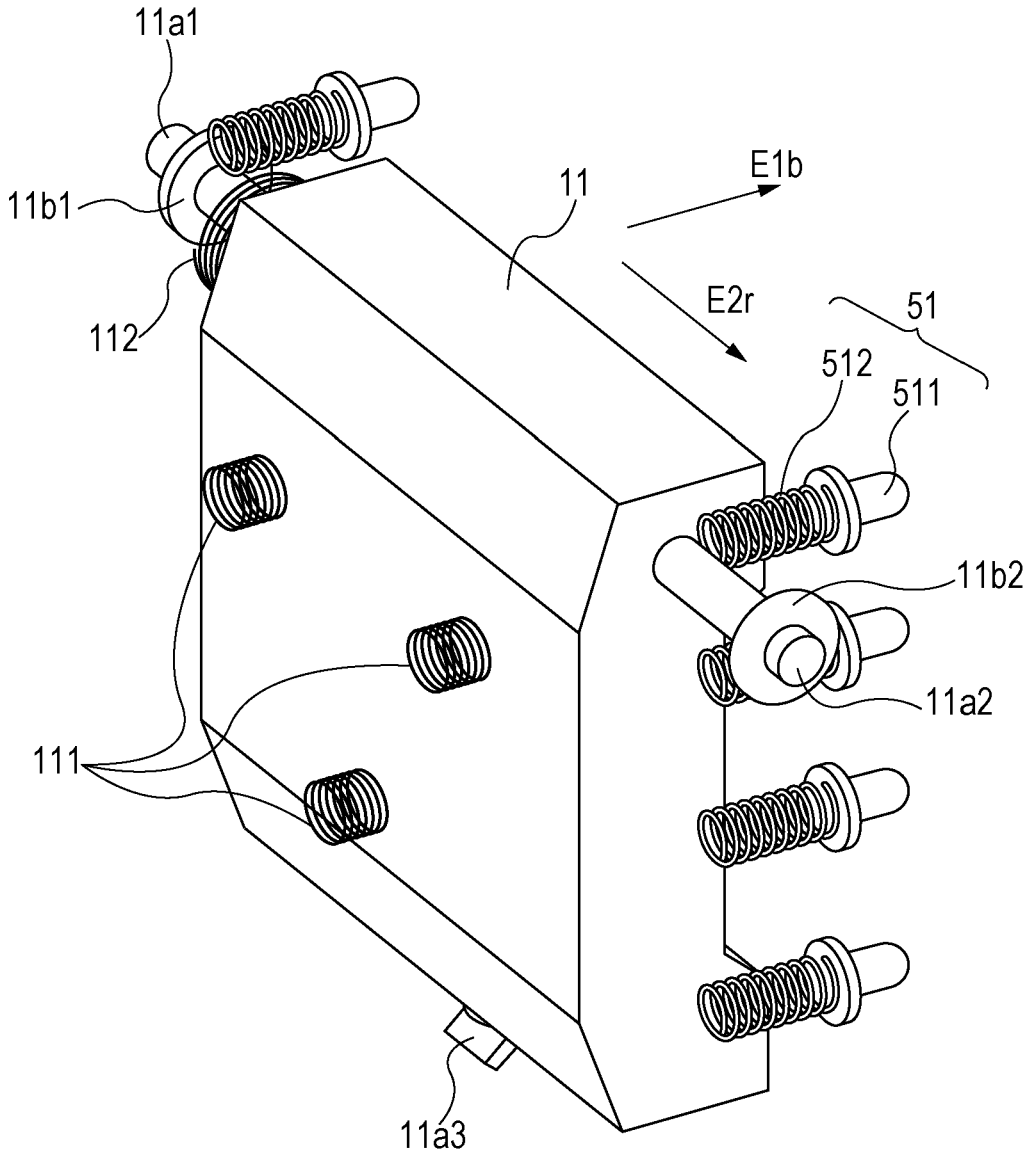
FIG. 13 is a diagram illustrating the positional relationship among the scanner unit, urging members, and compressing springs.

The cover unit 10, which is a covering member that opens and closes the opening 100B, will be described with reference to FIG. 10A to FIG. 13. FIG. 10A is a left back perspective view of the cover unit 10; FIG. 10B is a right front perspective view of the cover unit 10; FIG. 11A is a cross-sectional view of the cover unit 10 in the lateral direction; FIG. 11B is a cross-sectional view of the cover unit 10 taken along line XIB-XIB of FIG. 11A; FIG. 11C is a cross-sectional view of the cover unit 10 taken along line XIC-XIC of FIG. 11A; FIG. 12A is a cross-sectional view of the cover unit 10 in the front-to-back direction; FIG. 12B is a cross-sectional view of the cover unit 10 taken along line XIIB-XIIB of FIG. 12A; FIG. 13 is a diagram illustrating the positional relationship among the scanner unit 11, urging members, and compressing springs.

The image forming apparatus 100 of this embodiment is provided with the cover unit 10 for opening and closing the opening 100B.

Cartridge Urging Unit

The cover unit 10 is provided with the urging members 51*a* to 51*d* that urge the individual developing cartridges 33, as shown in FIG. 10A.

As shown in FIG. 11C, the urging members 51*a* to 51*d* each have a cartridge contact member 511 and a spring 512 in a housing 10*c* of the cover unit 10. When the cover unit 10 is closed, the urging members 51*a* to 51*d* come into contact with the individual cartridges 33 to urge the cartridges 33 toward the drums 32*a*, as described above. The urging force brings the developing rollers 33*b* of the cartridges 33 into contact with the photosensitive drums 32*a* with a predetermined pressure.

Scanner Mount Configuration

On the other hand, the cover unit 10 is equipped with the scanner unit 11, which is an exposing unit, as described above.

As shown in FIG. 13, the scanner unit 11 is provided with positioning projections 11*a*1 to 11*a*3, which are engaging portions for the subframe 31 serving as a support frame.

Of the three positioning projection 11*a*1 to 11*a*3, the upper two positioning projections 11*a*1 and 11*a*2 are cylindrical in shape and are located on the same axis. The two projections 11*a*1 and 11*a*2 have longitudinal-position restricting portions 11*b*1 and 11*b*2, respectively. As shown in FIG. 12A, the positioning projection 11*a*3 at the lower part of the scanner unit 11 has the shape of a bent cylinder.

The housing 10*c* of the cover unit 10 is a hollow housing, as shown in FIG. 11B, and the scanner unit 11 is located in the hollow portion. This configuration can prevent the operator, for example, from touching the optical components etc. of the scanner unit 11 or striking the cartridges 33 etc. against the scanner unit 11, thereby preventing troubles caused by the scanner unit 11.

As shown in FIGS. 12A and 12B, the foregoing three positioning projections 11*a*1 to 11*a*3 project outwards through openings 10*d*1 to 10*d*3 provided in the housing 10*c* of the housing 10, respectively.

As shown in FIG. 13, four compressing springs 111 and 112, which are elastic members, are provided between the scanner unit 11 and the inner wall of the cover unit housing 10*c*. The compressing springs 111 and 112 urge the scanner unit 11 in the directions of arrows E1*b* and E2*r*. For the direction of E1*b*, as shown in FIGS. 11B and 11C, the scanner unit 11 is urged by the three compressing springs 111 to bring the three positioning projections 11*a*1 to 11*a*3 to the openings 10*d*1 to 10*d*3 of the housing 10*c* of the cover unit 10, respectively. For the direction of E2*r*, as shown in FIG. 12B, the scanner unit 11 is urged by the compressing spring 112, so that the position restricting portion 11*b*1 of the positioning projection 11*a*1 is in contact with the outer wall 10*c*1 of the cover unit housing 10*c*. For the remaining direction of E3, as shown in FIG. 11C, the positioning projections 11*a*1 and 11*a*2 are roughly defined in the openings 10*d*1 and 10*d*2, respectively, with a gap therebetween.

As described above, the scanner unit 11 is mounted in the cover unit 10 via the compressing springs 111 and 112 which are elastic members. The scanner unit 11 is mounted so as to be moved relative to the cover unit housing 10*c* in any direction if a predetermined force or more is applied thereto.

Positioning of Scanner Unit

Figure 14:
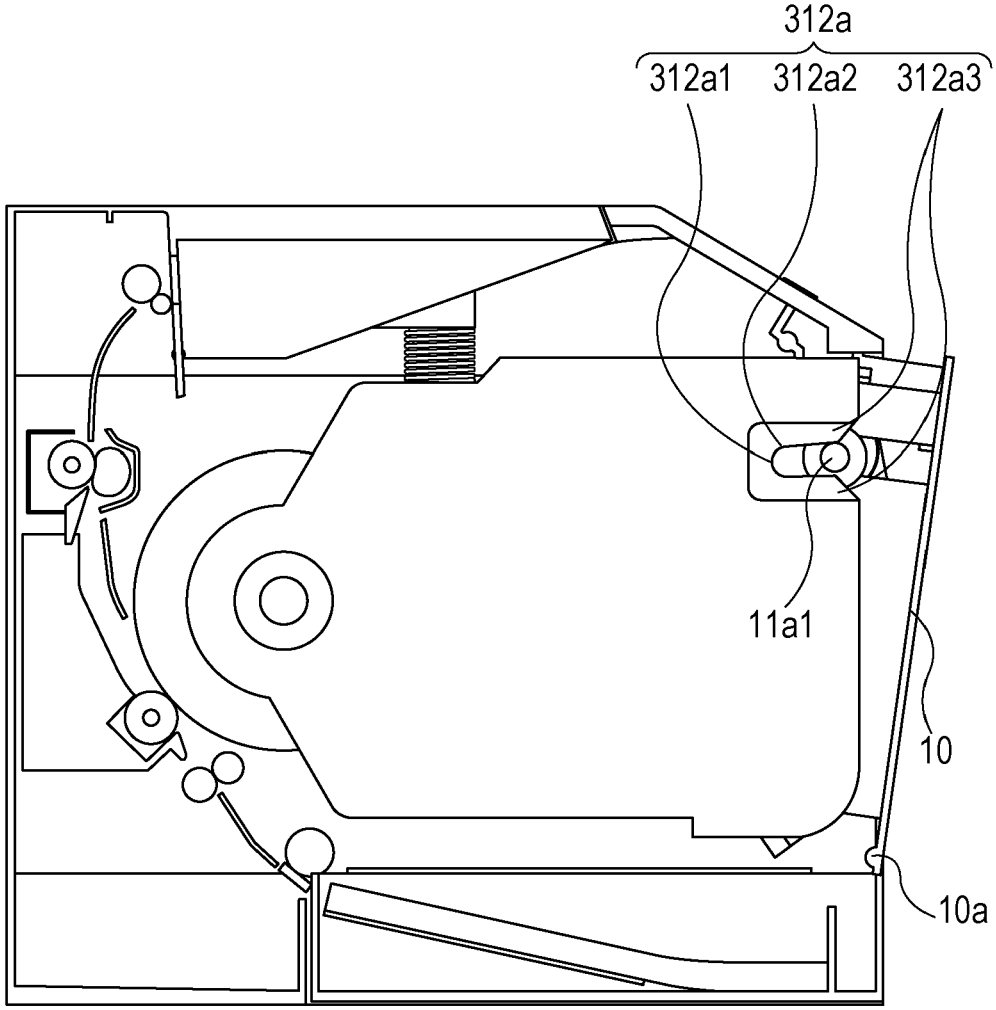
FIG. 14 is a diagram illustrating the behavior of the positioning projections of the scanner unit relative to the scanner guides during mounting.
Figure 15:
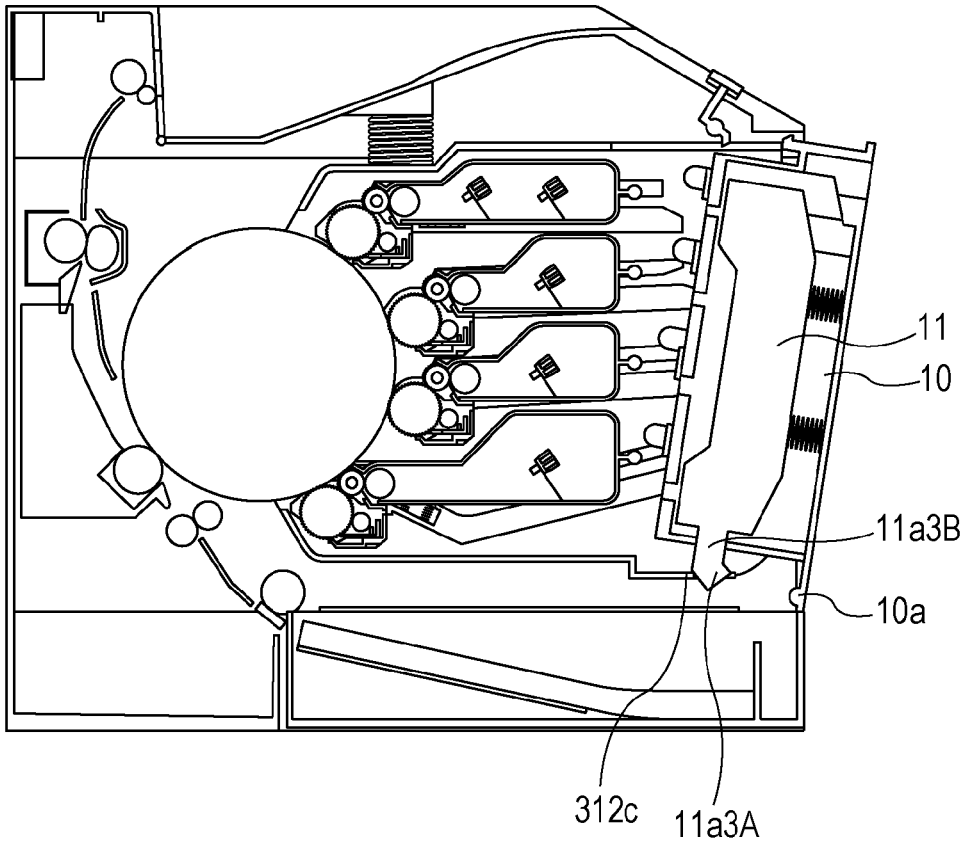
FIG. 15 is a diagram illustrating the behavior of the positioning projections of the scanner unit relative to the scanner guides during mounting.
Figure 16A:
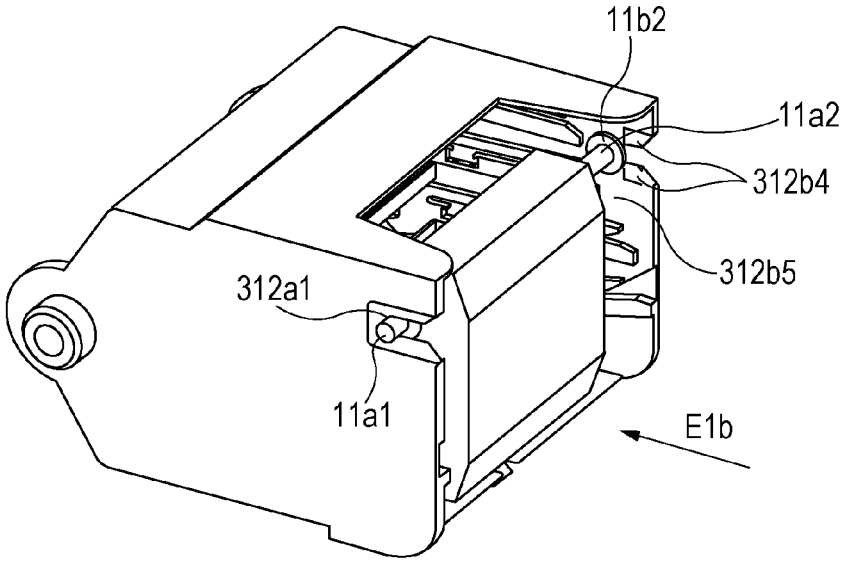
FIG. 16A is a diagram illustrating the positioning of the scanner unit relative to the image forming unit.
Figure 16B:
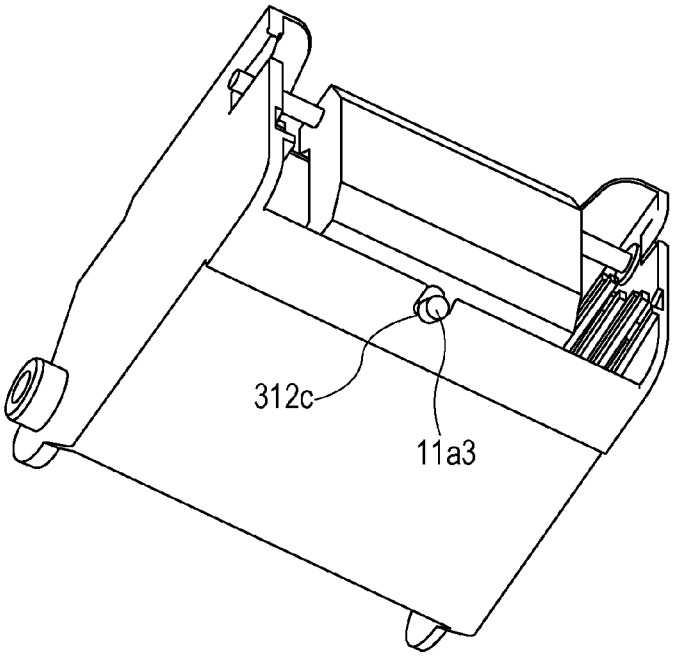
FIG. 16B is a diagram illustrating the positioning of the scanner unit relative to the image forming unit.

Next, the positioning of the scanner unit 11 when the cover unit 10 is located at the closing position at which the opening 100B is closed will be described with reference to FIGS. 5A to 5C, FIGS. 14 and 15, and FIGS. 16A and 16B. FIGS. 14 and 15 are diagrams illustrating the behavior of the positioning projections of the scanner unit 11 when being mounted and demounted to/from the scanner guides; and FIGS. 16A and 16B are diagrams illustrating the positioning of the scanner unit 11 to the image forming unit 200.

Configuration of Scanner Unit and Subframe

As described above, the scanner unit 11 is mounted in the cover unit 10 via the compressing springs 111 and 112. On the other hand, the subframe 31 of the image forming unit 200 is provided with scanner guides 312*a*, 312*b*, and 312*c*, which are engaged portions corresponding to the positioning projections 11*a*1 to 11*a*3 which are engaging portions of the scanner unit 11.

As shown in FIGS. 5A to 5C, there are three scanner guides 312*a*, 312*b*, and 312*c*, which correspond to the positioning projections 11*a*1 to 11*a*3 of the scanner unit 11, respectively.

As shown in FIG. 14, the scanner guides 312*a* and 312*b* have a groove shape in which arc shapes 312*a*1 and 312*b*1, straight line portions 312*a*2 and 312*b*2, and introductory portions 312*a*3 and 312*b*3 provided at the inlet are combined, respectively. The straight line portions 312*a*2 and 312*b*2 expand outwards with an increasing distance to the inlet. FIG. 14 shows only the scanner guide 312*a* at the left; however, the right scanner guide 312*b* has also the same shape having the arc shape 312*b*1, the straight line portion 312*b*2, and the introductory portion 312*b*3.

The portions of the scanner guides 312*a* and 312*b* inside the subframe 31 are slopes 312*a*4 and 312*b*4 (FIGS. 5A and 5B and FIG. 16A), respectively, that expand outwards with an increasing distance to the inlet.

The lower scanner guide 312*c* is a square groove whose corners are R-shaped, as shown in FIG. 5C.

Behavior of Scanner Unit in Cover-Unit Closing Operation

The scanner unit 11 is mounted in the cover unit 10 via the elastic members, and thus has a certain degree of flexibility. Therefore, when the cover unit 10 is moved close to the closing position, the positioning projections 11a1 and 11a2 are guided to the straight line portions 312a2 and 312b2 of the scanner guides 312a and 312b by the introductory portions 312a3 and 312b3 of the scanner guides 312a and 312b, respectively, as shown in FIG. 14. Although FIG. 14 shows only the scanner guide 312a and the positioning projection 11a1 at the left, the scanner guide 312b and the positioning projection 11a2 at the right have the same configuration.

The closing operation further proceeds, and the cover unit 10 reaches the closing position, the positioning projections 11a1 and 11a2 are guided to the positioning portions 312a1 and 312b1 of the scanner guides 312a and 312b by the straight line portions 312a2 and 312b2 of the scanner guides 312a and 312b, respectively. At that time, the positioning projections 11a1 and 11a2 are located and held at positions coaxial with the positioning portions 312a1 and 312b1 of the scanner guides 312a and 312b, shown in FIG. 16A, by the urging force of the compressing springs 111.

For the lower positioning projection 11a3, when the cover unit 10 is brought close to the closing position, first a bent portion 11a3A comes into contact with the scanner guide 312c, as shown in FIG. 15. As the closing operation further proceeds, and the cover unit 10 reaches the closing position, a vertical cylinder 11a3B comes into contact with the scanner guide 312c by the guide of the bent portion 11a3A of the positioning projection 11a3.

As the closing operation proceeds, the longitudinal-position restricting portion 11b2 of the positioning projection 11a2 of the scanner unit 11 is guided along the slope 312b4 against the urging force of the compressing spring 112. When the cover unit 10 reaches the closing position, the longitudinal-position restricting portion 11b2 is urged to an inner wall 312b5 by the compressing spring 112 to come into the contact position, as shown in FIG. 16A.

Positioning of Scanner Unit

As described above, when the cover unit 10 is located at the closing position at which the opening 100B is closed, the scanner unit 11 is positioned relative to the subframe 31, as shown in FIG. 16A. Here, FIG. 16A illustrates only the scanner unit 11 and the subframe 31 for the ease of understanding the positioning configuration of the scanner unit 11 relative to the subframe 31.

When the cover unit 10 reaches the closing position, the cover unit 10 is located such that the positioning projections 11a1 and 11a2 are fitted in the positioning portions 312a1 and 312a2 of the scanner guides 312a and 312b, respectively, as shown in FIG. 16A.

In this state, since the scanner unit 11 is urged in the direction of E1b by the compressing springs 111, the positioning projections 11a1 and 11a2 are pushed against the positioning portions 312a1 and 312a2 of the scanner guides 312a and 312b, respectively.

Therefore, the positioning projections 11a1 and 11a2 in the directions of E1 and E3 are positioned and held at a position in the directions of E1 and E3 at which the positioning projections 11a and 11a2 and the positioning portions 312a1 and 312a2 of the scanner guides 312a and 312b are coaxial. Even if the positions of the positioning projections 11a and 11a2 are determined in the directions of E1 and E3, the scanner unit 11 has flexibility in the direction in which it rotates about the positioning projections 11a1 and 11a2, and thus, it is not completely positioned. Thus, as shown in FIG. 16B, the lower positioning projection 11a3 is configured to come into contact with the scanner guide 312c so that the angle of the rotation about the positioning projections 11a and 11a2 can be determined.

With the above positioning configuration, the position of the scanner unit 11 relative to the subframe 31 in the directions of E1 and E3 can be determined.

For the position in the direction of E2, the scanner unit 11 is positioned because the position restricting portion 11b2 of the positioning projection 11a2 is pushed against the inner wall 312b5 of the subframe 31 by the compressing spring 112.

With such a configuration, the scanner unit 11 can be positioned relative to the subframe 31 that supports the intermediate transfer member 34, the drums 32a, and the developing cartridges 33 simply by closing the cover unit 10. As described above, since the positioning of the scanner unit 11 relative to the subframe 31 is performed using the urging forces of the compressing springs 111 and 112 interposed between the scanner unit 11 and the cover unit 10, there is no need to provide a separate urging member only for positioning.

Summary

Thus, the image forming apparatus 100 can perform an image forming operation (printing operation), and thus, the image forming operation as described above is performed on the basis of an image-formation start signal (printing start signal). In other words, a drive output portion (not shown) at the apparatus main body 100A side is connected to the gear 34b serving as a driving input unit for the intermediate transfer member 34 of the unit 200 at the image forming position. The drum gears 32a1 of the individual photosensitive drums 32a are connected to the gear 34b. The gears 50 of the developing rollers 33b of the cartridges 33 are connected to the drum gears 32a1.

Contacts at the apparatus main body 100A side are electrically connected to the electrical contacts between the photosensitive drums 32a and the cartridges 33. This allows the image forming apparatus 100 to perform an image forming operation.

As shown in FIG. 1B, the image forming apparatus 100 of this embodiment has the scanner unit 11, the cartridges 33, the drums 32a, the intermediate transfer member 34, and the conveying path for the recording medium S substantially side by side horizontally on the installation surface F. The output tray 100c is disposed at the upper part of the apparatus 100, and the cassette 19 is disposed at the lower part of the apparatus 100. The laser light beams L (LY, LM, LC, and LK) from the scanner unit 11 are emitted to the drums 32a from the front of the apparatus 100. Color developer images transferred from the drums 32a to the intermediate transfer member 34 are then transferred to the recording medium S at the opposite side to the drums 32a, with the intermediate transfer member 34 interposed therebetween.

Figure 17:
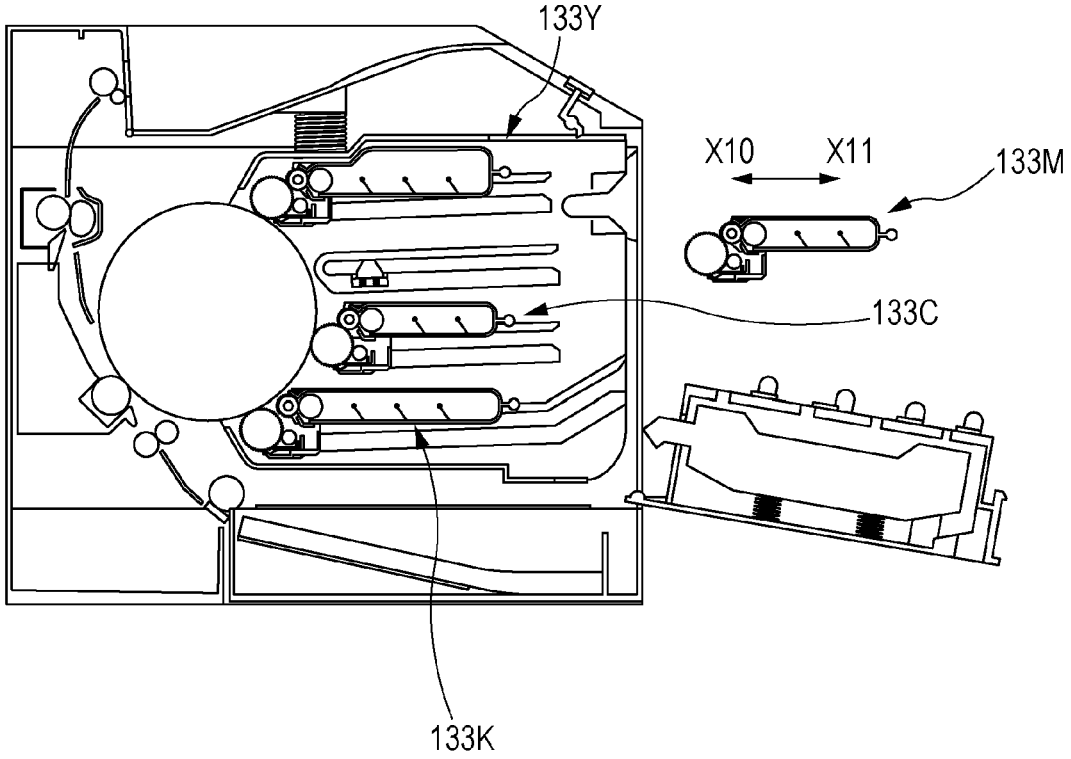
FIG. 17 is a diagram illustrating the mounting of a process cartridge including a photosensitive drum and a developing unit into an image forming apparatus.

This embodiment has been described taking the intermediate transfer member 34 for indirectly transferring images from the drums 32a to the recording medium S as an example of a transfer member; instead, a system of directly transferring images from the drums 32a to the recording medium S is also possible. In this case, the transfer member 34 plays the roll of directly transferring developer images on the drums 32a onto the recording medium S. This embodiment shows the configuration in which the replaceable cartridges are the developing cartridges 33; instead, it is also possible to have a configuration in which the replaceable cartridges are integrated process cartridges 133 in each of which the drum 32a, the charging roller 32b, the cleaning blade 32c, the developing roller 33b serving as a developing unit, etc. are integrated. FIG. 17 is a diagram illustrating the mounting of the integrated process cartridges 133 (133Y, 133M, 133C, and 133K) to the mount portions in the direction of arrow X10 and the demounting thereof from the mount portions in the direction of X11. In other words, cartridges that can be mounted and demounted to/from the apparatus main body may each have an electrophotographic photosensitive drum and a developing unit for developing an electrostatic latent image formed on the electrophotographic photosensitive drum.

As described above, with the configuration of this embodiment, the urging of the cartridges 33 is performed by the urging members 51 attached to the housing 10*c* of the cover unit 10. On the other hand, the scanner unit 11 is mounted in the housing 10*c* of the cover unit 10 via the compressing springs 111 and 112 which are elastic members, and the positioned is performed relative to the subframe 31, which is a supporting member, of the image forming unit 200. Thus, this embodiment is configured such that the scanner unit 11 is positioned directly to the subframe 31.

Therefore, if the housing 10*c* of the cover unit 10 is slightly deformed by urging the cartridges 33, the positions of the compressing springs 111 and 112 may change correspondingly to exert an influence on the force of urging the scanner unit 11. However, such a change in urging force due to the slight positional change has no influence on the position of the scanner unit 11.

Accordingly, this configuration can significantly reduce the adverse influence on an exposing process due to the urging of the cartridges 33 as compared with a configuration in which the scanner unit 11 is fixed in the housing 10*c* of the cover unit 10.

Furthermore, the scanner unit 11 can be positioned directly to the subframe 31 of the image forming unit 200, which supports and positions the drums 32*a* to be exposed to light, the cartridges 33, or cartridges each including the drum 32*a*. Therefore, this can achieve high-accuracy images and can reliably prevent the laser light beams L of the scanner unit 11 from being blocked by the cases 33*a* of the cartridges 33 or the like to cause underexposure. Here, the direct positioning of the scanner unit to the subframe is that the scanner unit is positioned by part thereof coming into contact with part of the subframe.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-273911 filed on Dec. 8, 2010, which is hereby incorporated by reference herein in its entirety.

What is claimed is:

1. An electrophotographic image forming apparatus comprising:

a plurality of electrophotographic photosensitive members;

an exposing unit configured to form electrostatic latent images on the plurality of electrophotographic photosensitive members;

a plurality of detachable cartridges configured to develop the electrostatic latent images to developer images;

a support frame that rotatably supports the plurality of electrophotographic photosensitive members and detachably supports the plurality of cartridges at positions opposing the respective plurality of electrophotographic photosensitive members; and a covering member that can be located at a closing position at which an opening for mounting and demounting the plurality of cartridges is closed and an opening position at which the opening is opened, the covering member having an urging member that urges the plurality of cartridges to the electrophotographic photosensitive members when the covering member is at the closing position, wherein the support frame is configured to be mounted to and demounted from a main body of the electrophotographic image forming apparatus, and wherein the exposing unit is movably mounted to the covering member via a plurality of elastic members and has an engaging portion that allows positioning of the exposing unit to the support frame by engaging with the support frame when the covering member is located at the closing position, wherein the plurality of elastic members includes a first elastic member and a second elastic member, and when the covering member is located at the closing position, the first elastic member urges the exposing unit in a first direction that brings the exposing unit close to the plurality of cartridges and the second elastic member urges the exposing unit in a second direction along an axial direction of the electrophotographic photosensitive member, and wherein when the covering member is located at the closing position, the positioning of the exposing unit is performed in the first direction and the second direction.

2. The electrophotographic image forming apparatus according to claim 1, wherein the covering member is configured as a housing, and the exposing unit is mounted inside the housing.

3. The electrophotographic image forming apparatus according to claim 1, wherein the support frame includes an engaged portion that is engaged with the engaging portion of the exposing unit.

4. The electrophotographic image forming apparatus according to claim 3, wherein the engaging portion of the exposing unit is urged to the engaged portion of the support frame by the plurality of elastic members, so that the positioning of the exposing unit to the support frame is performed.

5. An electrophotographic image forming apparatus comprising:

a plurality of cartridges that each include an electrophotographic photosensitive member and a developing unit configured to develop an electrostatic latent image formed on the electrophotographic photosensitive member to a developer image and that can be mounted to and demounted from a main body of the electrophotographic image forming apparatus;

an exposing unit configured to form electrostatic latent images on the electrophotographic photosensitive members provided at the plurality of cartridges;

an intermediate transfer member to which the developer images formed on the plurality of cartridges are transferred;

a support frame that rotatably supports the intermediate transfer member and detachably supports the plurality of cartridges at positions facing the intermediate transfer member;

a covering member that can be located at a closing position at which an opening for mounting and demounting the plurality of cartridges is closed and an opening position at which the opening is opened, the covering member having an urging member that urges the plurality of cartridges to the intermediate transfer member when the covering member is at the closing position, wherein the support frame is configured to be mounted to and demounted from a main body of the electrophotographic image forming apparatus;

wherein the exposing unit is movably mounted to the covering member via a plurality of elastic members and has an engaging portion that allows positioning of the exposing unit to the support frame by engaging with the support frame when the covering member is located at the closing position, wherein the plurality of elastic members includes a first elastic member and a second elastic member, and when the covering member is located at the closing position, the first elastic member urges the exposing unit in a first direction that brings the exposing unit close to the plurality of cartridges and the second elastic member urges the exposing unit in a second direction along an axial direction of the electrophotographic photosensitive member, and wherein when the covering member is located at the closing position, the positioning of the exposing unit is performed in the first direction and the second direction.

6. The electrophotographic image forming apparatus according to claim 5, wherein the covering member is configured as a housing, and the exposing unit is mounted inside the housing.

7. The electrophotographic image forming apparatus according to claim 5, wherein the support frame includes an engaged portion that is engaged with the engaging portion of the exposing unit.

8. The electrophotographic image forming apparatus according to claim 7, wherein the engaging portion of the exposing unit is urged to the engaged portion of the support frame by the plurality of elastic members, so that the positioning of the exposing unit to the support frame is performed.

* * * * *